US010214014B2

(12) United States Patent
Komamiya et al.

(10) Patent No.: US 10,214,014 B2
(45) Date of Patent: Feb. 26, 2019

(54) LIQUID EJECTION HEAD AND LIQUID EJECTION APPARATUS

(71) Applicant: CANON KABUSHIKI KAISHA, Tokyo (JP)

(72) Inventors: Yumi Komamiya, Kawasaki (JP); Takatsuna Aoki, Yokohama (JP); Shingo Okushima, Kawasaki (JP); Takuto Moriguchi, Kamakura (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/409,973

(22) Filed: Jan. 19, 2017

(65) Prior Publication Data

US 2017/0232737 A1 Aug. 17, 2017

(30) Foreign Application Priority Data

Feb. 12, 2016 (JP) ..... 2016-025233
Jan. 5, 2017 (JP) ..... 2017-000595

(51) Int. Cl.
*B41J 29/38* (2006.01)
*B41J 2/14* (2006.01)
(Continued)

(52) U.S. Cl.
CPC ..... *B41J 2/1404* (2013.01); *B41J 2/14145* (2013.01); *B41J 2/14153* (2013.01);
(Continued)

(58) Field of Classification Search
USPC ..... 347/14, 17, 70
See application file for complete search history.

(56) References Cited

U.S. PATENT DOCUMENTS 6,074,034 A * 6/2000 Maeda ..... B41J 2/04541 347/167
6,955,424 B2 10/2005 Silverbrook et al.
(Continued)

FOREIGN PATENT DOCUMENTS

CN 101092074 A 12/2007
CN 101092075 A 12/2007

OTHER PUBLICATIONS

U.S. Appl. No. 15/383,204, Shingo Okushima, Seiichiro Karita, Takatsuna Aoki, Noriyasu Nagai, Eisuke Nishitani, Yumi Komamiya, filed Dec. 19, 2016.

(Continued)

*Primary Examiner* — Lam Nguyen
(74) *Attorney, Agent, or Firm* — Venable LLP

(57) ABSTRACT

In a liquid ejection head, it is possible to suppress generation of a temperature distribution of liquid in a direction in which ejection openings are arranged in a print element board. Specifically, a liquid ejection head, which is provided with an ejection opening row in which a plurality of ejection openings for ejecting a liquid are arranged, includes a pressure chamber that communicates with the ejection openings and includes a pressure generation element, a passage which is provided with an opening and extends along the ejection opening row to supply the liquid flowing into the passage through the opening to the pressure chamber, a heater provided around the opening, and a temperature sensor provided in a region along the ejection opening row.

15 Claims, 32 Drawing Sheets

(51) Int. Cl.
*B41J 2/155* (2006.01)
*B41J 2/18* (2006.01)

(52) U.S. Cl.
CPC ..... *B41J 2/155* (2013.01); *B41J 2/18* (2013.01); *B41J 2202/12* (2013.01); *B41J 2202/20* (2013.01)

(56) References Cited

U.S. PATENT DOCUMENTS

| | | | | |
|---|---|---|---|---|
| 7,690,751 | B2 | 4/2010 | Takabayashi et al. | |
| 7,722,148 | B2 | 5/2010 | Takabayashi et al. | |
| 7,802,866 | B2 | 9/2010 | Kanno et al. | |
| 7,914,106 | B2 | 3/2011 | Takabayashi et al. | |
| 8,210,640 | B2 | 7/2012 | Takabayashi et al. | |
| 8,517,518 | B2 | 8/2013 | Kashu et al. | |
| 8,794,733 | B2 | 8/2014 | Kanno et al. | |
| 8,870,353 | B2 * | 10/2014 | Watanabe | B41J 2/14274 347/70 |
| 2009/0225123 | A1 * | 9/2009 | Katoh | B41J 2/175 347/17 |
| 2013/0194335 | A1 * | 8/2013 | Nodsu | B41J 29/38 347/14 |
| 2015/0239238 | A1 | 8/2015 | Yamada et al. | |

OTHER PUBLICATIONS

Office Action dated Oct. 12, 2018, in Chinese Patent Application No. 201710073914.4.

* cited by examiner

LIQUID EJECTION HEAD AND LIQUID EJECTION APPARATUS

BACKGROUND OF THE INVENTION

Field of the Invention

The present invention relates to a liquid ejection head and a liquid ejection apparatus, and more specifically to a configuration for controlling a temperature of the liquid ejection head.

Description of the Related Art

In a liquid ejection head in which a plurality of liquid ejection openings are provided, a temperature of ink is made even with respect to the respective ejection openings by controlling temperatures of the liquid ejection head. In this way, for example, a variation in the amount of ink ejected from the respective ejection openings is suppressed.

Meanwhile, as described in U.S. Pat. No. 6,955,424, there is a liquid ejection head in which ejection opening rows of different types of ink and individual passages along the respective ejection opening rows are formed in one print element board included in the liquid ejection head. In this configuration, liquid is supplied to respective ejection openings of the corresponding ejection opening rows from the respective passages. In this way, a size of the print element board may be set to be small when the liquid ejection head for a plurality of types of ink is configured. As a result, it is possible to achieve miniaturization of the liquid ejection head and a cost reduction.

In a liquid ejection head, a print element board and liquid inside the passage provided in the board tend to increase in temperature due to driving of a heating element associated with ejection of liquid. Meanwhile, liquid newly flowing into the passage of the print element board is relatively lower in temperature than the print element board, and functions to decreases a temperature of the print element board.

Herein, in the print element board described in U.S. Pat. No. 6,955,424, a plurality of openings for guiding liquid to the passage along the ejection opening row are arranged in a direction in which the passage extends. For this reason, a temperature difference occurs between liquid ejected from an ejection opening around the opening and liquid ejected from an ejection opening in a region separated from the opening due to liquid, a temperature of which is relatively low, flowing into the openings. As a result, a temperature distribution may be generated in liquid ejected from the plurality of ejection openings in the ejection opening rows, and the amount of ejected liquid may vary.

SUMMARY OF THE INVENTION

An object of the invention is to provide a liquid ejection head and a liquid ejection apparatus capable of suppressing generation of a temperature distribution of liquid in a direction in which ejection openings are arranged in a print element board.

In a first aspect of the present invention there is provided a liquid ejection head provided with an ejection opening row in which a plurality of ejection openings for ejecting a liquid are arranged, the liquid ejection head comprising: a pressure chamber that communicates with the ejection opening and includes a pressure generation element inside the pressure chamber, the pressure generation element generating a pressure used for ejecting the liquid; an opening for supplying the liquid to the pressure chamber; a passage extending along the ejection opening row to supply the liquid flowing in from the opening to the pressure chamber; a heater provided around the opening; and a temperature sensor provided in a region along the ejection opening row.

In a second aspect of the present invention there is provided a liquid ejection apparatus that ejects a liquid using a liquid ejection head provided with an ejection opening row in which a plurality of ejection openings for ejecting the liquid are arranged, wherein the liquid ejection head includes a pressure chamber that communicates with the ejection openings and includes a pressure generation element inside the pressure chamber, an opening, a passage extending along the ejection opening row to supply the liquid flowing in from the opening to the pressure chamber, a heater provided around the opening, and a temperature sensor provided in a region along the ejection opening row, the liquid ejection apparatus includes control unit configured to control a temperature of the liquid ejection head, and the control unit controls driving of the heater based on a temperature detected by the temperature sensor.

In a third aspect of the present invention there is provided a liquid ejection head comprising: an ejection opening row in which a plurality of ejection openings for ejecting a liquid are arranged; a plurality of elements provided at positions opposing the plurality of ejection openings, respectively, to generate energy used to eject the liquid; a plurality of pressure chambers including the plurality of elements therein; an opening row in which a plurality of openings communicating with the plurality of pressure chambers are arranged along the ejection opening row; a heater row in which a plurality of heaters are arranged along the opening row; and a temperature sensor row in which a plurality of temperature sensors are arranged along the opening row.

According to the above configuration, it is possible to suppress generation of a temperature distribution of liquid in a direction in which ejection openings are arranged in a print element board.

Further features of the present invention will become apparent from the following description of exemplary embodiments (with reference to the attached drawings).

DESCRIPTION OF THE EMBODIMENTS

Hereinafter, embodiments of the present invention and embodiments to which the present invention is applied will be described with reference to the drawings. Additionally, a liquid ejection head that ejects liquid such as ink and a liquid ejection apparatus that mounts the liquid ejection head according to the present invention can be applied to a printer, a copying machine, a facsimile machine having a communication system, a word processor having a printer, and an industrial printing apparatus combined with various processing devices. For example, the liquid ejection head and the liquid ejection apparatus can be used to manufacture a biochip or print an electronic circuit.

(Description of Inkjet Printing Apparatus of First Embodiment)

Figure 1:
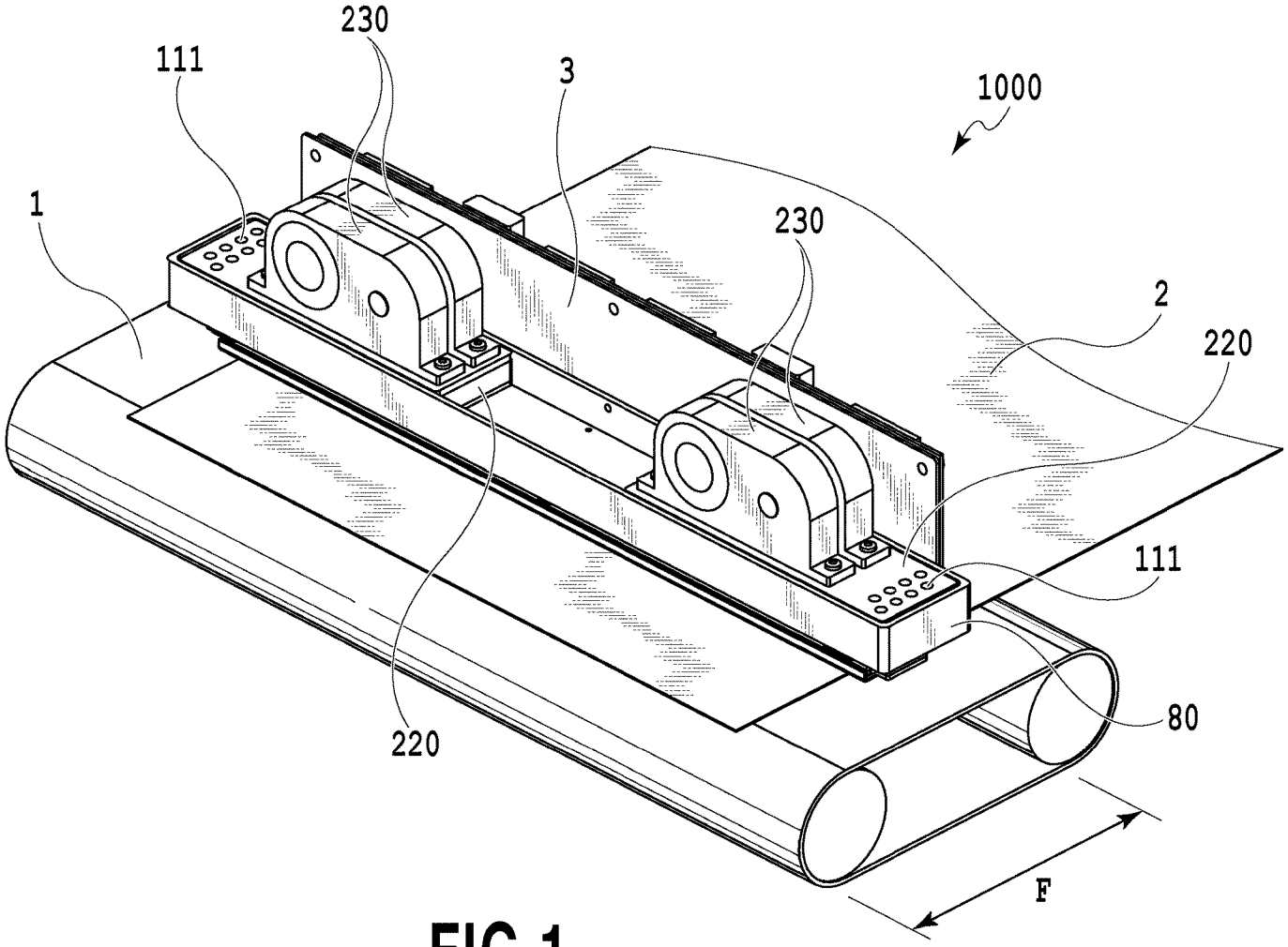
FIG. 1 is a view illustrating a schematic configuration of an ink jet printing apparatus according to an embodiment of a liquid ejection apparatus of the present invention that ejects a liquid.

FIG. 1 is a diagram illustrating a schematic configuration of a liquid ejection apparatus that ejects a liquid in the invention and particularly an inkjet printing apparatus (hereinafter, also referred to as a printing apparatus) 1000 that prints an image by ejecting ink. The printing apparatus 1000 includes a conveying unit 1 which conveys a print medium 2 and a line type (page wide type) liquid ejection head 3 which is disposed to be substantially orthogonal to the conveying direction of the print medium 2. Then, the printing apparatus 1000 is a line type printing apparatus which continuously prints an image at one pass by ejecting ink onto the relative moving print mediums 2 while continuously or intermittently conveying the print mediums 2. The liquid ejection head 3 includes a negative pressure control unit 230 which controls a pressure (a negative pressure) inside a circulation path, a liquid supply unit 220 which communicates with the negative pressure control unit 230 so that a fluid can flow therebetween, a liquid connection portion 111 which serves as an ink supply opening and an ink discharge opening of the liquid supply unit 220, and a casing 80. The print medium 2 is not limited to a cut sheet and may be also a continuous roll medium. The liquid ejection head 3 can print a full color image by inks of cyan C, magenta M, yellow Y, and black K and is fluid-connected to a liquid supply member, a main tank, and a buffer tank (see FIG. 2 to be described later) which serve as a supply path supplying a liquid to the liquid ejection head 3. Further, the control unit which supplies power and transmits an ejection control signal to the liquid ejection head 3 is electrically connected to the liquid ejection head 3. The liquid path and the electric signal path in the liquid ejection head 3 will be described later.

The printing apparatus 1000 is an inkjet printing apparatus that circulates a liquid such as ink between a tank to be described later and the liquid ejection head 3. The circulation configuration includes a first circulation configuration in which the liquid is circulated by the activation of two circulation pumps (for high and low pressures) at the downstream side of the liquid ejection head 3 and a second circulation configuration in which the liquid is circulated by the activation of two circulation pumps (for high and low pressures) at the upstream side of the liquid ejection head 3. Hereinafter, the first circulation configuration and the second circulation configuration of the circulation will be described.

(Description of First Circulation Configuration)

Figure 2:
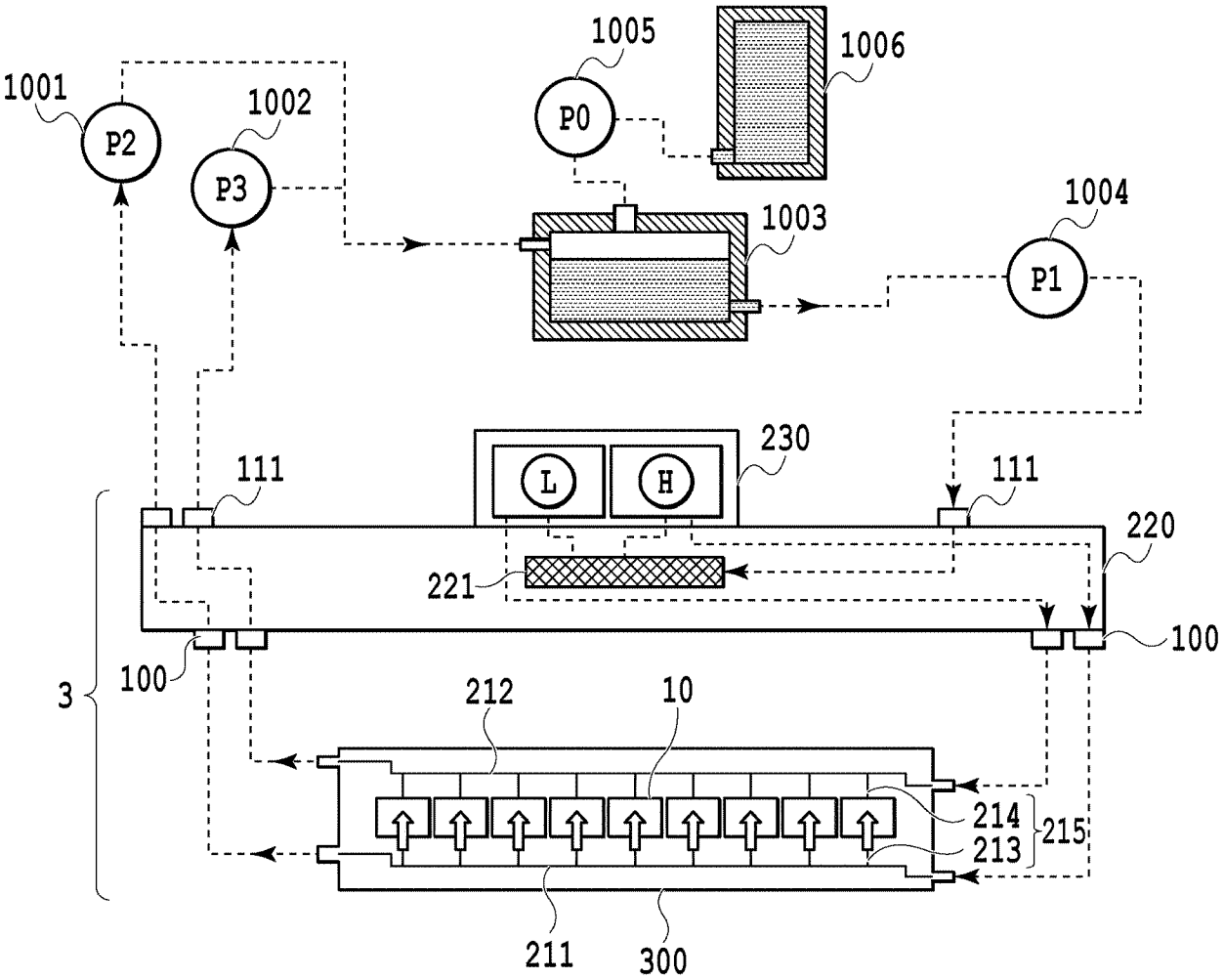
FIG. 2 is a diagram illustrating a first circulation configuration in a circulation path applied to a printing apparatus of the embodiment.

FIG. 2 is a schematic diagram illustrating the first circulation configuration in the circulation path applied to the printing apparatus 1000 of the embodiment. The liquid ejection head 3 is fluid-connected to a first circulation pump (the high pressure side) 1001, a first circulation pump (the low pressure side) 1002, and a buffer tank 1003. Further, in FIG. 2, in order to simplify a description, a path through which ink of one color of cyan C, magenta M, yellow Y, and black K flows is illustrated. However, in fact, four colors of circulation paths are provided in the liquid ejection head 3 and the printing apparatus body.

In the first circulation configuration, ink inside a main tank 1006 is supplied into the buffer tank 1003 by a replenishing pump 1005 and then is supplied to the liquid supply unit 220 of the liquid ejection head 3 through the liquid connection portion 111 by a second circulation pump 1004. Subsequently, the ink which is adjusted to two different negative pressures (high and low pressures) by the negative pressure control unit 230 connected to the liquid supply unit 220 is circulated while being divided into two passages having the high and low pressures. The ink inside the liquid ejection head 3 is circulated in the liquid ejection head by the action of the first circulation pump (the high pressure side) 1001 and the first circulation pump (the low pressure side) 1002 at the downstream side of the liquid ejection head 3, is discharged from the liquid ejection head 3 through the liquid connection portion 111, and is returned to the buffer tank 1003.

The buffer tank 1003 which is a sub-tank includes an atmosphere communication opening (not illustrated) which is connected to the main tank 1006 to communicate the inside of the tank with the outside and thus can discharge bubbles inside the ink to the outside. The replenishing pump 1005 is provided between the buffer tank 1003 and the main tank 1006. The replenishing pump 1005 delivers the ink from the main tank 1006 to the buffer tank 1003 after the ink is consumed by the ejection (the discharge) of the ink from the ejection opening of the liquid ejection head 3 in the printing operation and the suction collection operation.

Two first circulation pumps 1001 and 1002 draw the liquid from the liquid connection portion 111 of the liquid ejection head 3 so that the liquid flows to the buffer tank 1003. As the first circulation pump, a displacement pump having quantitative liquid delivery ability is desirable. Specifically, a tube pump, a gear pump, a diaphragm pump, and a syringe pump can be exemplified. However, for example, a general constant flow valve or a general relief valve may be disposed at an outlet of a pump to ensure a predetermined flow rate. When the liquid ejection head 3 is driven, the first circulation pump (the high pressure side) 1001 and the first circulation pump (the low pressure side) 1002 are operated so that the ink flows at a predetermined flow rate through a common supply passage 211 and a common collection passage 212. Since the ink flows in this way, the temperature of the liquid ejection head 3 during a printing operation is kept at an optimal temperature. The predetermined flow rate when the liquid ejection head 3 is driven is desirably set to be equal to or higher than a flow rate at which a difference in temperature among the print element boards 10 inside the liquid ejection head 3 does not influence printing quality. Above all, when a too high flow rate is set, a difference in negative pressure among the print element boards 10 increases due to the influence of pressure loss of the passage inside a liquid ejection unit 300 and thus unevenness in density is caused. For that reason, it is desirable to set the flow rate in consideration of a difference in temperature and a difference in negative pressure among the print element boards 10.

The negative pressure control unit 230 is provided in a path between the second circulation pump 1004 and the liquid ejection unit 300. The negative pressure control unit 230 is operated to keep a pressure at the downstream side (that is, a pressure near the liquid ejection unit 300) of the negative pressure control unit 230 at a predetermined pressure even when the flow rate of the ink changes in the circulation system due to a difference in ejection amount per unit area. As two negative pressure control mechanisms constituting the negative pressure control unit 230, any mechanism may be used as long as a pressure at the downstream side of the negative pressure control unit 230 can be controlled within a predetermined range or less from a desired set pressure. As an example, a mechanism such as a so-called "pressure reduction regulator" can be employed. In the circulation passage of the embodiment, the upstream side of the negative pressure control unit 230 is pressurized by the second circulation pump 1004 through the liquid supply unit 220. With such a configuration, since an influence of a water head pressure of the buffer tank 1003 with respect to the liquid ejection head 3 can be suppressed, a degree of freedom in layout of the buffer tank 1003 of the printing apparatus 1000 can be widened.

As the second circulation pump 1004, a turbo pump or a displacement pump can be used as long as a predetermined head pressure or more can be exhibited in the range of the ink circulation flow rate used when the liquid ejection head 3 is driven. Specifically, a diaphragm pump can be used. Further, for example, a water head tank disposed to have a certain water head difference with respect to the negative pressure control unit 230 can be also used instead of the second circulation pump 1004.

As illustrated in FIG. 2, the negative pressure control unit 230 includes two negative pressure adjustment mechanisms H, L respectively having different control pressures. Among two negative pressure adjustment mechanisms, a relatively high pressure side (indicated by "H" in FIG. 2) and a relatively low pressure side (indicated by "L" in FIG. 2) are respectively connected to the common supply passage 211 and the common collection passage 212 inside the liquid ejection unit 300 through the liquid supply unit 220. The liquid ejection unit 300 is provided with the common supply passage 211, the common collection passage 212, and an individual passage 215 (an individual supply passage 213 and an individual collection passage 214) communicating with the print element board. The negative pressure control mechanism H is connected to the common supply passage 211, the negative pressure control mechanism L is connected to the common collection passage 212, and a differential pressure is formed between two common passages. Then, since the individual passage 215 communicates with the common supply passage 211 and the common collection passage 212, a flow (a flow indicated by an arrow direction of FIG. 2) is generated in which a part of the liquid flows from the common supply passage 211 to the common collection passage 212 through the passage formed inside the print element board 10. The two negative pressure adjustment mechanisms H, L are connected to passages from the liquid connection portion 111 through the filter 221.

In this way, the liquid ejection unit 300 has a flow in which a part of the liquid passes through the print element boards 10 while the liquid flows to pass through the common supply passage 211 and the common collection passage 212. For this reason, heat generated by the print element boards 10 can be discharged to the outside of the print element board 10 by the ink flowing through the common supply passage 211 and the common collection passage 212. With such a configuration, the flow of the ink can be generated even in the pressure chamber or the ejection opening not ejecting the liquid when an image is printed by the liquid ejection head 3. Accordingly, the thickening of the ink can be suppressed in such a manner that the viscosity of the ink thickened inside the ejection opening is decreased. Further, the thickened ink or the foreign material in the ink can be discharged toward the common collection passage 212. For this reason, the liquid ejection head 3 of the embodiment can print a high-quality image at a high speed.

(Description of Second Circulation Configuration)

Figure 3:
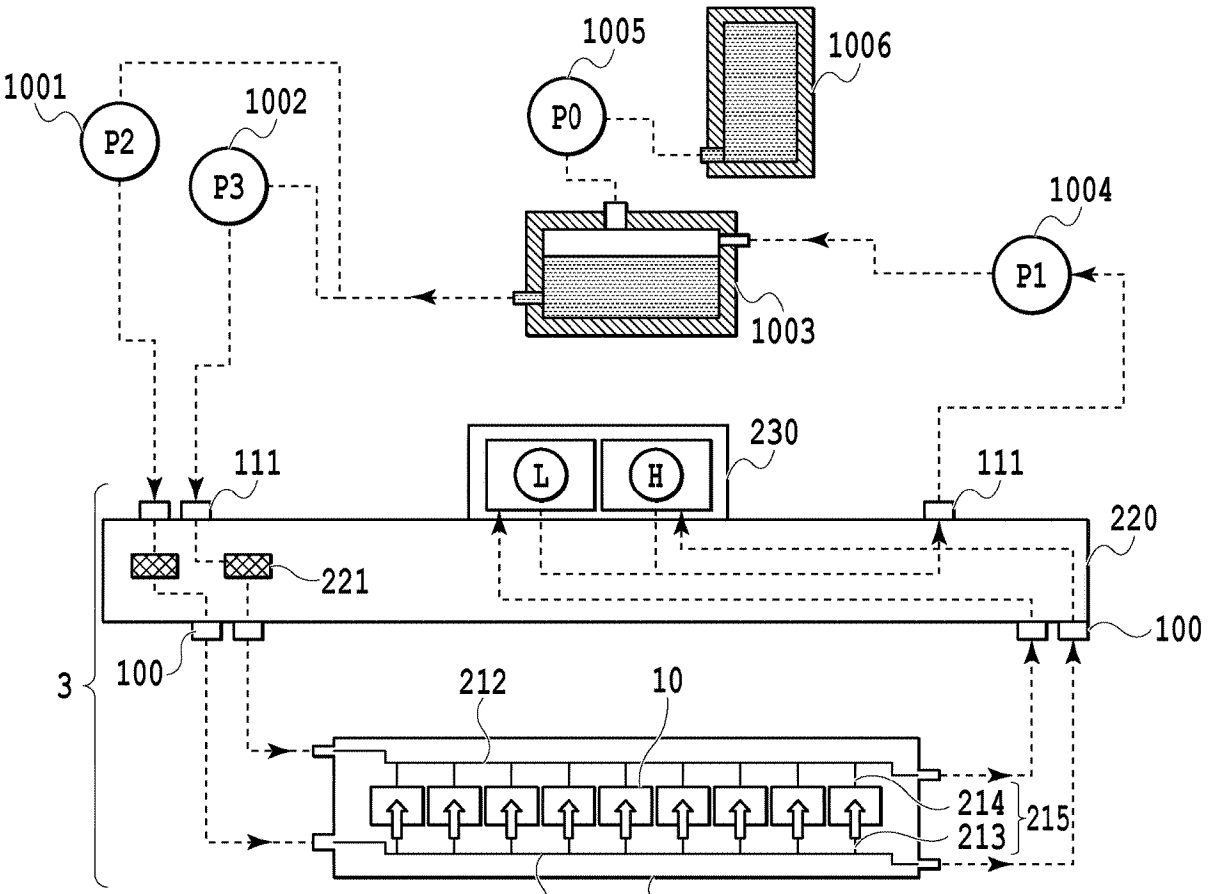
FIG. 3 is a diagram illustrating a second circulation configuration in the circulation path applied to the printing apparatus of the embodiment.

FIG. 3 is a schematic diagram illustrating the second circulation configuration which is a circulation configuration different from the first circulation configuration in the circulation path applied to the printing apparatus of the embodiment. A main difference from the first circulation configuration is that two negative pressure control mechanisms constituting the negative pressure control unit 230 both control a pressure at the upstream side of the negative pressure control unit 230 within a predetermined range from a desired set pressure. Further, another difference from the first circulation configuration is that the second circulation pump 1004 serves as a negative pressure source which reduces a pressure at the downstream side of the negative pressure control unit 230. Further, still another difference is that the first circulation pump (the high pressure side) 1001 and the first circulation pump (the low pressure side) 1002 are disposed at the upstream side of the liquid ejection head 3 and the negative pressure control unit 230 is disposed at the downstream side of the liquid ejection head 3.

In the second circulation configuration, as shown in FIG. 3, the ink inside the main tank 1006 is supplied to the buffer tank 1003 by the replenishing pump 1005. Subsequently, the ink is divided into two passages and is circulated in two passages at the high pressure side and the low pressure side by the action of the negative pressure control unit 230 provided in the liquid ejection head 3. The ink which is divided into two passages at the high pressure side and the low pressure side is supplied to the liquid ejection head 3 through the liquid connection portion 111 by the action of the first circulation pump (the high pressure side) 1001 and the first circulation pump (the low pressure side) 1002. Subsequently, the ink circulated inside the liquid ejection head by the action of the first circulation pump (the high pressure side) 1001 and the first circulation pump (the low pressure side) 1002 is discharged from the liquid ejection head 3 through the liquid connection portion 111 by the negative pressure control unit 230. The discharged ink is returned to the buffer tank 1003 by the second circulation pump 1004.

In the second circulation configuration, the negative pressure control unit 230 stabilizes a change in pressure at the upstream side (that is, the liquid ejection unit 300) of the negative pressure control unit 230 within a predetermined range from a predetermined pressure even when a change in flow rate is caused by a change in ejection amount per unit area. In the circulation passage of the embodiment, the downstream side of the negative pressure control unit 230 is pressurized by the second circulation pump 1004 through the liquid supply unit 220. With such a configuration, since an influence of a water head pressure of the buffer tank 1003 with respect to the liquid ejection head 3 can be suppressed, the layout of the buffer tank 1003 in the printing apparatus 1000 can have many options. Instead of the second circulation pump 1004, for example, a water head tank disposed to have a predetermined water head difference with respect to the negative pressure control unit 230 can be also used. Similarly to the first circulation configuration, in the second circulation configuration, the negative pressure control unit 230 includes two negative pressure control mechanisms respectively having different control pressures. Among two negative pressure adjustment mechanisms, a high pressure side (indicated by "H" in FIG. 3) and a low pressure side (indicated by "L" in FIG. 3) are respectively connected to the common supply passage 211 or the common collection passage 212 inside the liquid ejection unit 300 through the liquid supply unit 220. When the pressure of the common supply passage 211 is set to be higher than the pressure of the common collection passage 212 by two negative pressure adjustment mechanisms, a flow of the liquid is formed from the common supply passage 211 to the common collection passage 212 through the individual passage 215 and the passages formed inside the print element boards 10.

In such a second circulation configuration, the same liquid flow as that of the first circulation configuration can be obtained inside the liquid ejection unit 300, but has two advantages different from those of the first circulation configuration. As a first advantage, in the second circulation configuration, since the negative pressure control unit 230 is disposed at the downstream side of the liquid ejection head 3, there is low concern that a foreign material or a trash produced from the negative pressure control unit 230 flows into the liquid ejection head 3. As a second advantage, in the second circulation configuration, a maximal value of the flow rate necessary for the liquid from the buffer tank 1003 to the liquid ejection head 3 is smaller than that of the first circulation configuration. The reason is as below.

In the case of the circulation in the print standby state, the sum of the flow rates of the common supply passage 211 and the common collection passage 212 is set to a flow rate A. The value of the flow rate A is defined as a minimal flow rate necessary to adjust the temperature of the liquid ejection head 3 in the print standby state so that a difference in temperature inside the liquid ejection unit 300 falls within a desired range. Further, the ejection flow rate obtained when the ink is ejected from all ejection openings of the liquid ejection unit 300 (the full ejection state) is defined as a flow rate F (the ejection amount per each ejection opening×the ejection frequency per unit time×the number of the ejection openings).

Figure 4:
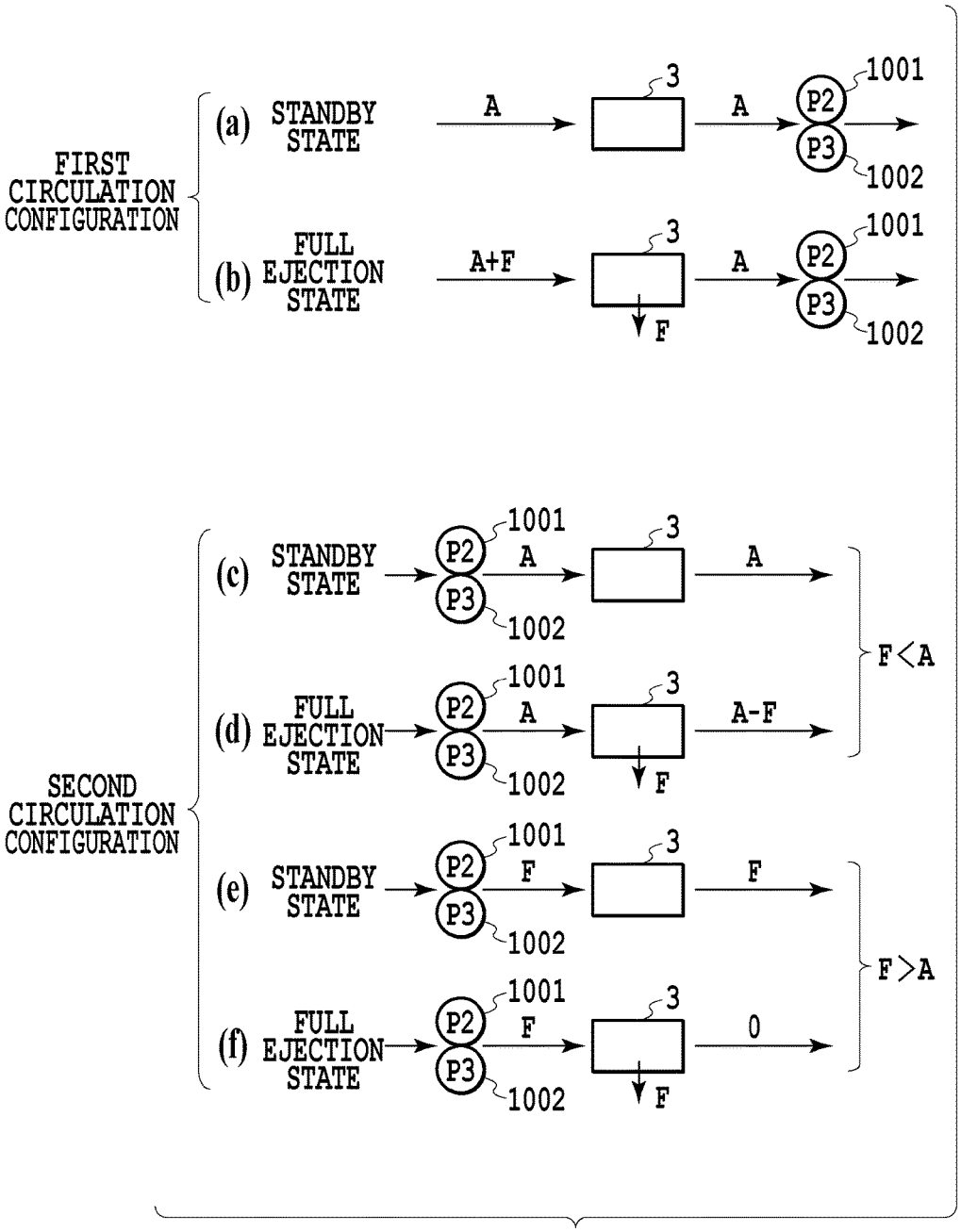
FIG. 4 is a diagram illustrating a difference in ink inflow amount to a liquid ejection head between the first circulation configuration and the second circulation configuration.

FIG. 4 is a schematic diagram illustrating a difference in ink inflow amount to the liquid ejection head between the first circulation configuration and the second circulation configuration. FIG. 4(*a*) illustrates the standby state in the first circulation configuration and FIG. 4(*b*) illustrates the full ejection state in the first circulation configuration. FIGS. 4(*c*) to 4(*f*) illustrate the second circulation passage. Here, FIGS. 4(*c*) and 4(*d*) illustrate a case where the flow rate F is lower than the flow rate A and FIGS. 4(*e*) and 4(*f*) illustrate a case where the flow rate F is higher than the flow rate A. In this way, the flow rates in the standby state and the full ejection state are illustrated.

In the case of the first circulation configuration (FIGS. 4(*a*) and 4(*b*)) in which the first circulation pump 1001 and the first circulation pump 1002 each having a quantitative liquid delivery ability are disposed at the downstream side of the liquid ejection head 3, the total flow rate of the first circulation pump 1001 and the first circulation pump 1002 becomes the flow rate A. By the flow rate A, the temperature inside the liquid ejection unit 300 in the standby state can be managed. Then, in the case of the full ejection state of the liquid ejection head 3, the total flow rate of the first circulation pump 1001 and the first circulation pump 1002 becomes the flow rate A. However, a maximal flow rate of the liquid supplied to the liquid ejection head 3 is obtained such that the flow rate F consumed by the full ejection is added to the flow rate A of the total flow rate by the action of the negative pressure generated by the ejection of the liquid ejection head 3. Thus, a maximal value of the supply amount to the liquid ejection head 3 satisfies a relation of the flow rate A+the flow rate F since the flow rate F is added to the flow rate A (FIG. 4(*b*)).

Meanwhile, in the case of the second circulation configuration (FIGS. 4(*c*) to 4(*f*)) in which the first circulation pump 1001 and the first circulation pump 1002 are disposed at the upstream side of the liquid ejection head 3, the supply amount to the liquid ejection head 3 necessary for the print standby state becomes the flow rate A similarly to the first circulation configuration. Thus, when the flow rate A is higher than the flow rate F (FIGS. 4(*c*) and 4(*d*)) in the second circulation configuration in which the first circulation pump 1001 and the first circulation pump 1002 are disposed at the upstream side of the liquid ejection head 3, the supply amount to the liquid ejection head 3 sufficiently becomes the flow rate A even in the full ejection state. At that time, the discharge flow rate of the liquid ejection head 3 satisfies a relation of the flow rate A−the flow rate F (FIG. 4(*d*)). However, when the flow rate F is higher than the flow rate A (FIGS. 4(*e*) and 4(*f*)), the flow rate becomes insufficient when the flow rate of the liquid supplied to the liquid ejection head 3 becomes the flow rate A in the full ejection state. For that reason, when the flow rate F is higher than the flow rate A, the supply amount to the liquid ejection head 3 needs to be set to the flow rate F. At that time, since the flow rate F is consumed by the liquid ejection head 3 in the full ejection state, the flow rate of the liquid discharged from the liquid ejection head 3 becomes almost zero (FIG. 4(*f*)). In addition, if the liquid is not ejected in the full ejection state when the flow rate F is higher than the flow rate A, the liquid which is attracted by the amount consumed by the ejection of the flow rate F is discharged from the liquid ejection head 3.

In this way, in the case of the second circulation configuration, the total value of the flow rates set for the first circulation pump 1001 and the first circulation pump 1002, that is, the maximal value of the necessary supply flow rate becomes a large value among the flow rate A and the flow rate F. For this reason, as long as the liquid ejection unit 300 having the same configuration is used, the maximal value (the flow rate A or the flow rate F) of the supply amount necessary for the second circulation configuration becomes smaller than the maximal value (the flow rate A+the flow rate F) of the supply flow rate necessary for the first circulation configuration.

For that reason, in the case of the second circulation configuration, the degree of freedom of the applicable circulation pump increases. For example, a circulation pump having a simple configuration and low cost can be used or a load of a cooler (not illustrated) provided in a main body side path can be reduced. Accordingly, there is an advantage that the cost of the printing apparatus can be decreased. This advantage is high in the line head having a relatively large value of the flow rate A or the flow rate F. Accordingly, a line head having a longer longitudinal length among the line heads is beneficial.

Meanwhile, the first circulation configuration is more advantageous than the second circulation configuration. That is, in the second circulation configuration, since the flow rate of the liquid flowing through the liquid ejection unit 300 in the print standby state becomes maximal, a higher negative pressure is applied to the ejection openings as the ejection amount per unit area of the image (hereinafter, also referred to as a low-duty image) becomes smaller. For this reason, when the passage width is narrow and the negative pressure is high, a high negative pressure is applied to the ejection opening in the low-duty image in which unevenness easily appears. Accordingly, there is concern that printing quality may be deteriorated in accordance with an increase in the number of so-called satellite droplets ejected along with main droplets of the ink. Meanwhile, in the case of the first circulation configuration, since a high negative pressure is applied to the ejection opening when the image (hereinafter, also referred to as a high-duty image) having a large ejection amount per unit area is formed, there is an advantage that an influence of satellite droplets on the image is small even when many satellite droplets are generated. Two circulation configurations can be desirably selected in consideration of the specifications (the ejection flow rate F, the minimal circulation flow rate A, and the passage resistance inside the head) of the liquid ejection head and the printing apparatus body.

(Description of Configuration of Liquid Ejection Head)

Figure 5A:
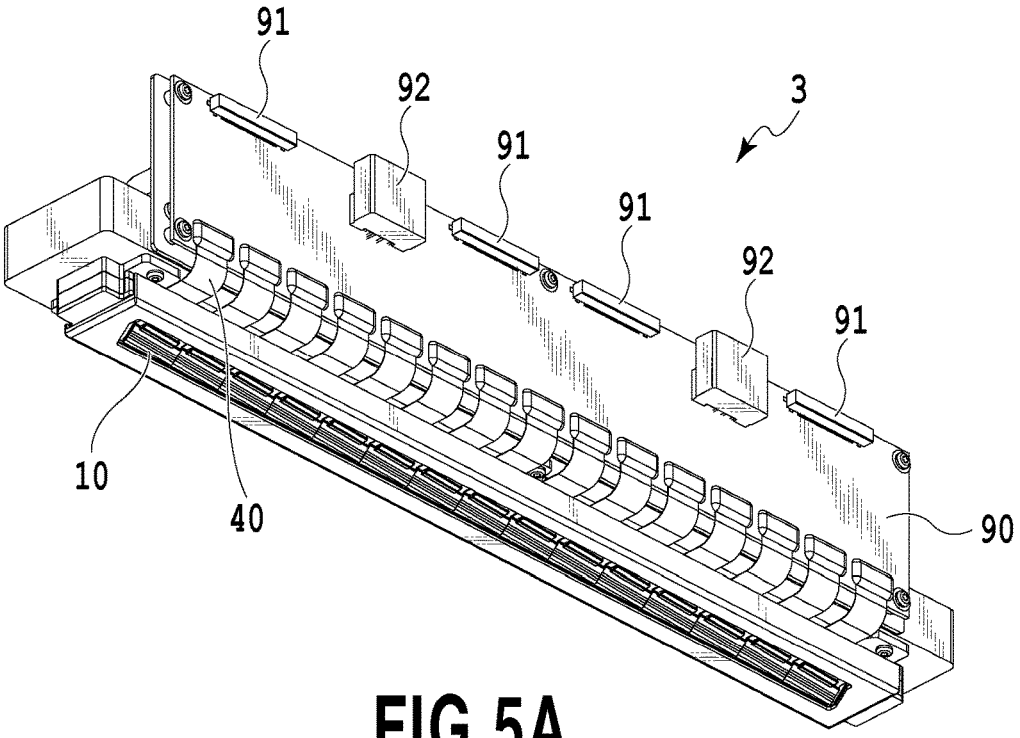
FIGS. 5A and 5B are perspective views illustrating the liquid ejection head of the embodiment.
Figure 5B:
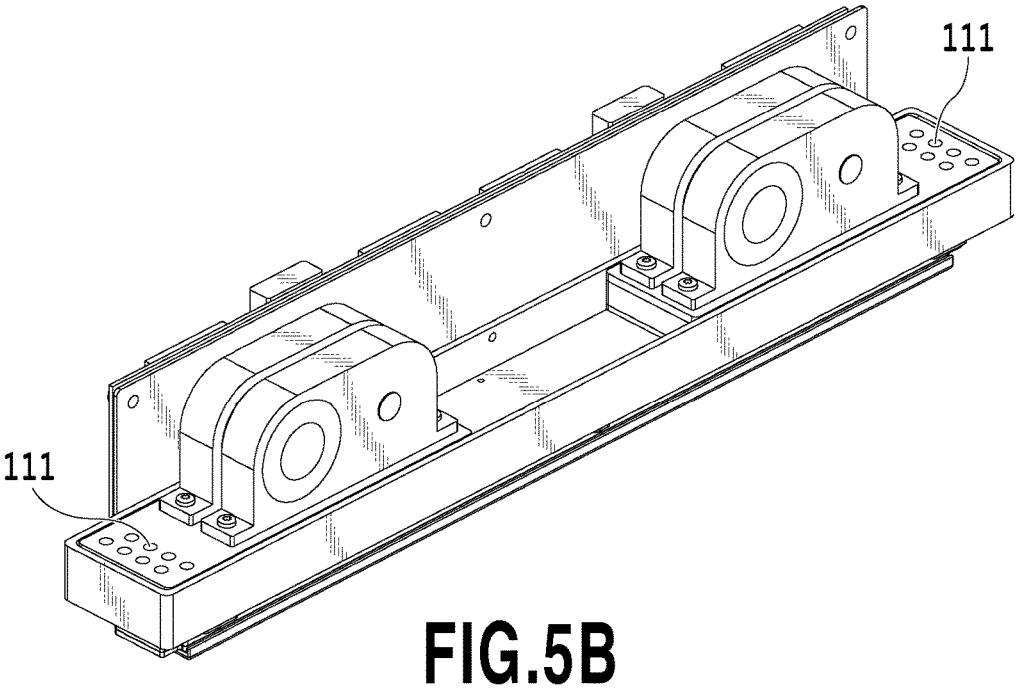

A configuration of the liquid ejection head 3 according to the first embodiment will be described. FIGS. 5A and 5B are perspective views illustrating the liquid ejection head 3 according to the embodiment. The liquid ejection head 3 is a line type liquid ejection head in which fifteen print element boards 10 capable of ejecting inks of four colors of cyan C, magenta M, yellow Y, and black K are arranged in series on one print element board (an in-line arrangement). As illustrated in FIG. 5A, the liquid ejection head 3 includes the print element boards 10 and a signal input terminal 91 and a power supply terminal 92 which are electrically connected to each other through a flexible circuit board 40 and an electric wiring board 90 capable of supplying electric energy to the print element board 10. The signal input terminal 91 and the power supply terminal 92 are electrically connected to the control unit of the printing apparatus 1000 so that an ejection drive signal and power necessary for the ejection are supplied to the print element board 10. When the wirings are integrated by the electric circuit inside the electric wiring board 90, the number of the signal input terminals 91 and the power supply terminals 92 can be decreased compared with the number of the print element boards 10. Accordingly, the number of electrical connection components to be separated when the liquid ejection head 3 is assembled to the printing apparatus 1000 or the liquid ejection head is replaced decreases. As illustrated in FIG. 5B, the liquid connection portions 111 which are provided at both ends of the liquid ejection head 3 are connected to the liquid supply system of the printing apparatus 1000. Accordingly, the inks of four colors including cyan C, magenta M, yellow Y, and black K4 are supplied from the supply system of the printing apparatus 1000 to the liquid ejection head 3 and the inks passing through the liquid ejection head 3 are collected by the supply system of the printing apparatus 1000. In this way, the inks of different colors can be circulated through the path of the printing apparatus 1000 and the path of the liquid ejection head 3.

Figure 6:
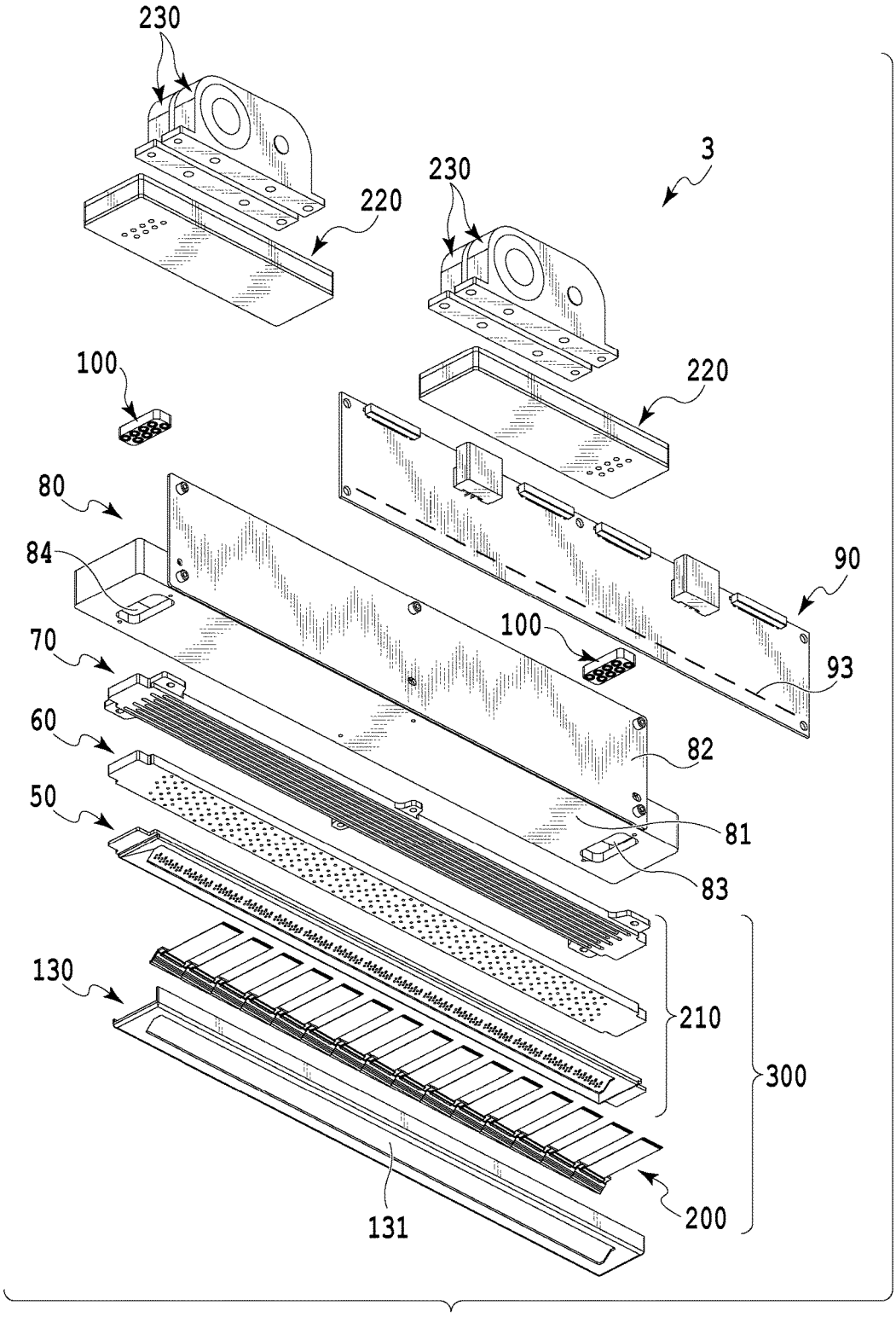
FIG. 6 is an exploded perspective view illustrating components or units constituting the liquid ejection head.

FIG. 6 is an exploded perspective view illustrating components or units constituting the liquid ejection head 3. The liquid ejection unit 300, the liquid supply unit 220, and the electric wiring board 90 are attached to the casing 80. The liquid connection portions 111 (see FIG. 3) are provided in the liquid supply unit 220. Also, in order to remove a foreign material in the supplied ink, filters 221 (see FIGS. 2 and 3) for different colors are provided inside the liquid supply unit 220 while communicating with the openings of the liquid connection portions 111. Two liquid supply units 220 respectively corresponding to two colors are provided with the filters 221. The liquid passing through the filter 221 is supplied to the negative pressure control unit 230 disposed on the liquid supply unit 220 disposed to correspond to each color. The negative pressure control unit 230 is a unit which includes different colors of negative pressure control valves. By the function of a spring member or a valve provided therein, a change in pressure loss inside the supply system (the supply system at the upstream side of the liquid ejection head 3) of the printing apparatus 1000 caused by a change in flow rate of the liquid is largely decreased. Accordingly, the negative pressure control unit 230 can stabilize a change negative pressure at the downstream side (the liquid ejection unit 300) of the negative pressure control unit within a predetermined range. As described in FIG. 2, two negative pressure control valves of different colors are built inside the negative pressure control unit 230. Two negative pressure control valves are respectively set to different control pressures. Here, the high pressure side communicates with the common supply passage 211 (see FIG. 2) inside the liquid ejection unit 300 and the low pressure side communicates with the common collection passage 212 (see FIG. 2) through the liquid supply unit 220.

The casing 80 includes a liquid ejection unit support portion 81 and an electric wiring board support portion 82 and ensures the rigidity of the liquid ejection head 3 while supporting the liquid ejection unit 300 and the electric wiring board 90. The electric wiring board support portion 82 is used to support the electric wiring board 90 and is fixed to the liquid ejection unit support portion 81 by a screw. The liquid ejection unit support portion 81 is used to correct the warpage or deformation of the liquid ejection unit 300 to ensure the relative position accuracy among the print element boards 10. Accordingly, stripe and unevenness of a printed medium is suppressed. For that reason, it is desirable that the liquid ejection unit support portion 81 have sufficient rigidity. As a material, metal such as SUS or aluminum or ceramic such as alumina is desirable. The liquid ejection unit support portion 81 is provided with openings 83 and 84 into which a joint rubber 100 is inserted. The liquid supplied from the liquid supply unit 220 is led to a third passage member 70 constituting the liquid ejection unit 300 through the joint rubber.

The liquid ejection unit 300 includes a plurality of ejection modules 200 and a passage member 210 and a cover member 130 is attached to a face near the print medium in the liquid ejection unit 300. Here, the cover member 130 is a member having a picture frame shaped surface and provided with an elongated opening 131 as illustrated in FIG. 6 and the print element board 10 and a sealing member 110 (see FIG. 10A to be described later) included in the ejection module 200 are exposed from the opening 131. A peripheral frame of the opening 131 serves as a contact face of a cap member that caps the liquid ejection head 3 in the print standby state. For this reason, it is desirable to form a closed space in a capping state by applying an adhesive, a sealing material, and a filling material along the periphery of the opening 131 to fill unevenness or a gap on the ejection opening face of the liquid ejection unit 300.

Next, a configuration of the passage member 210 included in the liquid ejection unit 300 will be described. As illustrated in FIG. 6, the passage member 210 is obtained by laminating a first passage member 50, a second passage member 60, and a third passage member 70 and distributes the liquid supplied from the liquid supply unit 220 to the ejection modules 200. Further, the passage member 210 is a passage member that returns the liquid re-circulated from the ejection module 200 to the liquid supply unit 220. The passage member 210 is fixed to the liquid ejection unit support portion 81 by a screw and thus the warpage or deformation of the passage member 210 is suppressed.

Figure 7:
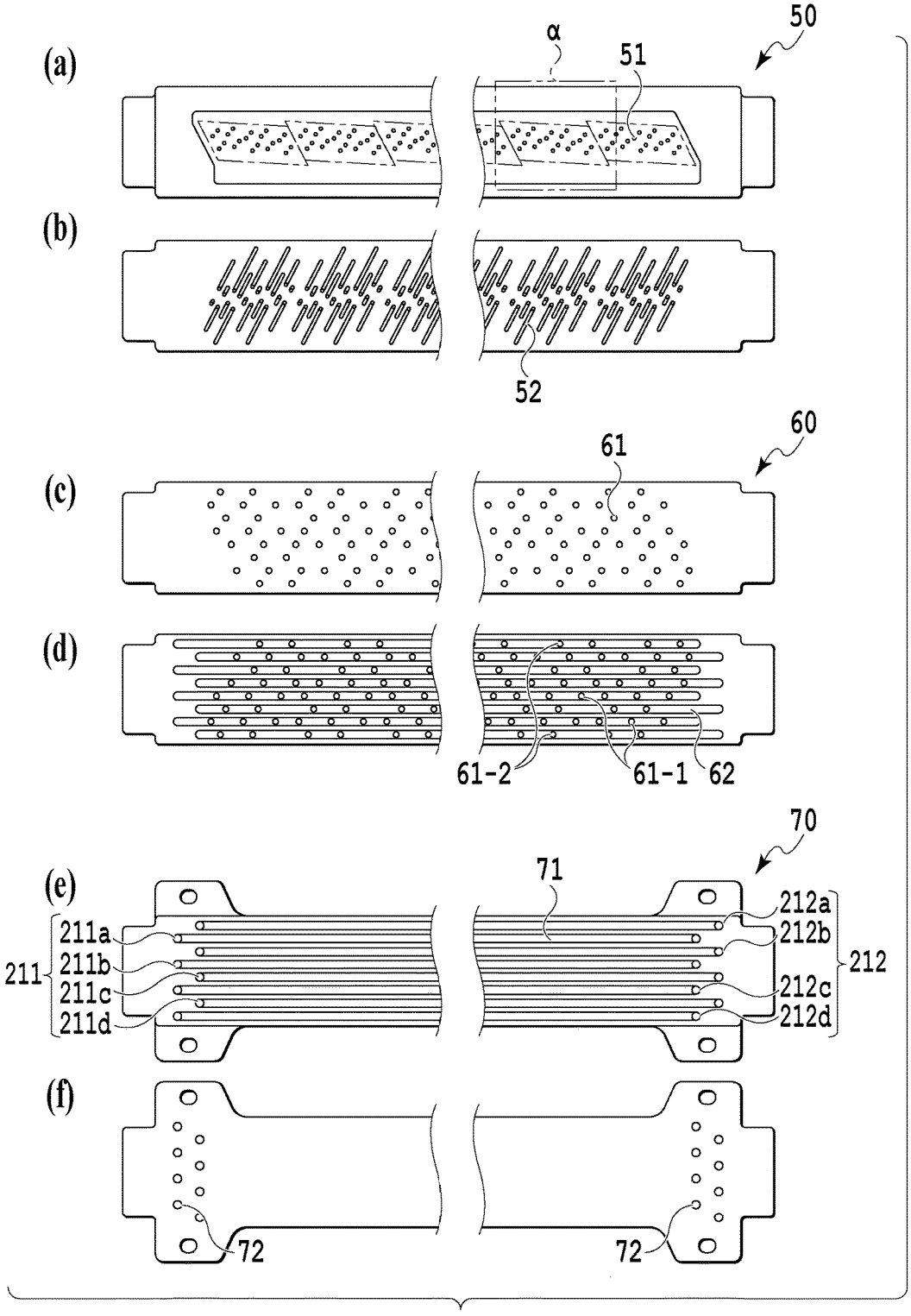
FIG. 7 is diagram illustrating front and rear faces of each of first to third passage members.

FIGS. 7(*a*) to 7(*f*) are diagrams illustrating front and rear faces of the first to third passage members. FIG. 7(*a*) illustrates a face onto which the ejection module 200 is mounted in the first passage member 50 and FIG. 7(*f*) illustrates a face with which the liquid ejection unit support portion 81 comes into contact in the third passage member 70. The first passage member 50 and the second passage member 60 are bonded to teach other so that the parts illustrated in FIGS. 7(*b*) and 7(*c*) and corresponding to the contact faces of the passage members face each other and the second passage member and the third passage member are bonded to each other so that the parts illustrated in FIGS. 7(*d*) and 7(*e*) and corresponding to the contact faces of the passage members face each other. When the second passage member 60 and the third passage member 70 are bonded to each other, eight common passages (211*a*, 211*b*, 211*c*, 211*d*, 212*a*, 212*b*, 212*c*, 212*d*) extending in the longitudinal direction of the passage member are formed by common passage grooves 62 and 71 of the passage members. Accordingly, a set of the common supply passage 211 and the common collection passage 212 is formed inside the passage member 210 to correspond to each color. The ink is supplied from the common supply passage 211 to the liquid ejection head 3 and the ink supplied to the liquid ejection head 3 is collected by the common collection passage 212. A communication opening 72 (see FIG. 7(*f*)) of the third passage member 70 communicates with the holes of the joint rubber 100 and is fluid-connected to the liquid supply unit 220 (see FIG. 6). A bottom face of the common passage groove 62 of the second passage member 60 is provided with a plurality of communication openings 61 (a communication opening 61-1 communicating with the common supply passage 211 and a communication opening 61-2 communicating with the common collection passage 212) and communicates with one end of an individual passage groove 52 of the first passage member 50. The other end of the individual passage groove of the first passage member 50 is provided with a communication opening 51 and is fluid-connected to the ejection modules 200 through the communication opening 51. By the individual passage groove 52, the passages can be densely provided at the center side of the passage member.

It is desirable that the first to third passage members be formed of a material having corrosion resistance with respect to a liquid and having a low linear expansion coefficient. As a material, for example, a composite material (resin) obtained by adding inorganic filler such as fiber or fine silica particles to a base material such as alumina, LCP (liquid crystal polymer), PPS (polyphenyl sulfide), PSF (polysulfone), or modified PPE (polyphenylene ether) can be appropriately used. As a method of forming the passage member 210, three passage members may be laminated and adhered to one another. When a resin composite material is selected as a material, a bonding method using welding may be used.

Figure 8:
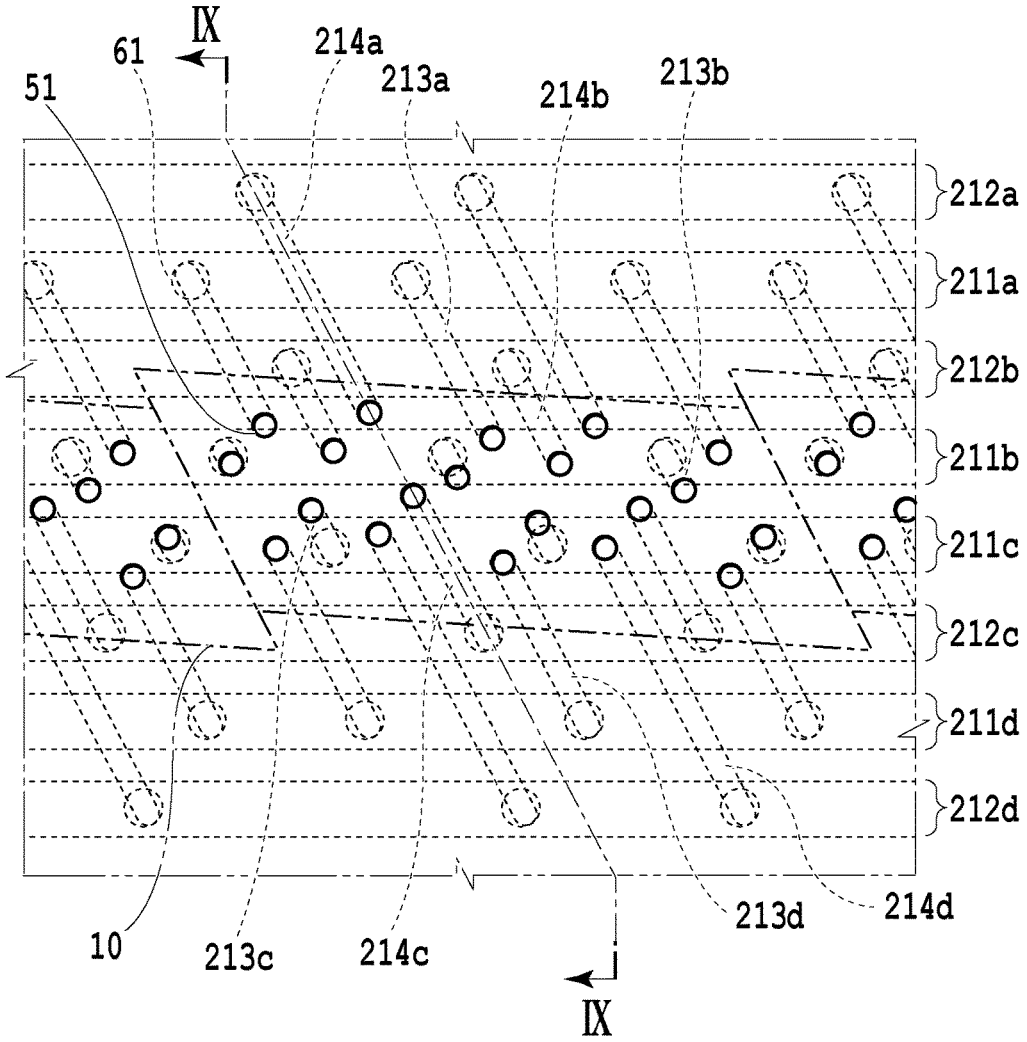
FIG. 8 is a transparent view illustrating a passage in the passage members which is formed by connecting the first to third passage members.

FIG. 8 is a partially enlarged perspective view illustrating a part α of FIG. 7(*a*) and illustrating the passages inside the passage member 210 formed by bonding the first to third passage members to one another when viewed from a face onto which the ejection module 200 is mounted in the first passage member 50. The common supply passage 211 and the common collection passage 212 are formed such that the common supply passage 211 and the common collection passage 212 are alternately disposed from the passages of both ends. Here, a connection relation among the passages inside the passage member 210 will be described.

The passage member 210 is provided with the common supply passage 211 (211*a*, 211*b*, 211*c*, 211*d*) and the common collection passage 212 (212*a*, 212*b*, 212*c*, 212*d*) extending in the longitudinal direction of the liquid ejection head 3 and provided for each color. The individual supply passages 213 (213*a*, 213*b*, 213*c*, 213*d*) which are formed by the individual passage grooves 52 are connected to the common supply passages 211 of different colors through the communication openings 61. Further, the individual collection passages 214 (214*a*, 214*b*, 214*c*, 214*d*) formed by the individual passage grooves 52 are connected to the common collection passages 212 of different colors through the communication openings 61. With such a passage configuration, the ink can be intensively supplied to the print element board 10 located at the center portion of the passage member from the common supply passages 211 through the individual supply passages 213. Further, the ink can be collected from the print element board 10 to the common collection passages 212 through the individual collection passages 214.

Figure 9:
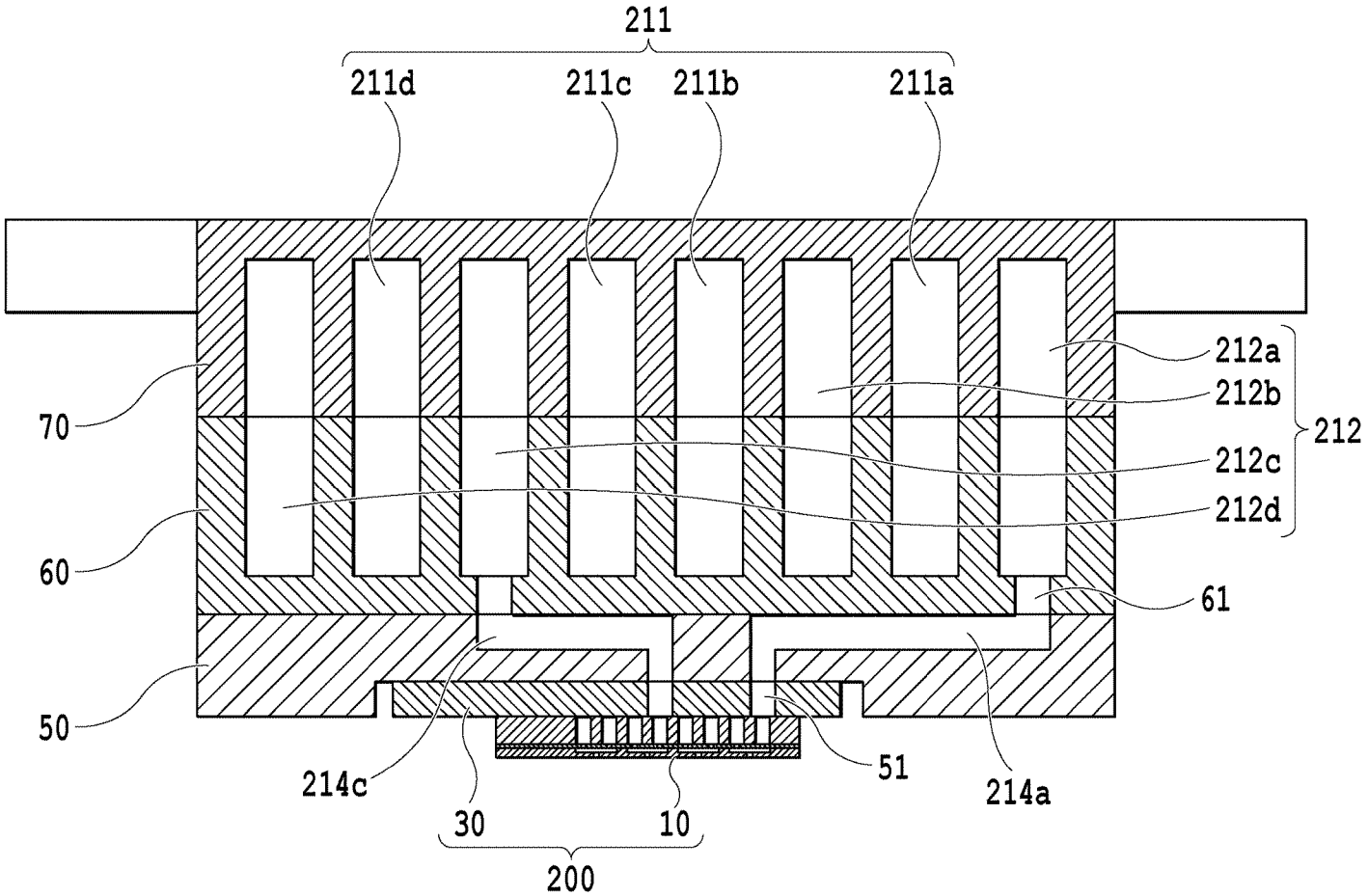
FIG. 9 is a cross-sectional view taken along a line IX-IX of FIG. 8.

FIG. 9 is a cross-sectional view taken along a line IX-IX of FIG. 8. The individual collection passage (214*a*, 214*c*) communicates with the ejection module 200 through the communication opening 51. In FIG. 9, only the individual collection passage (214*a*, 214*c*) is illustrated, but in a different cross-section, the individual supply passage 213 and the ejection module 200 communicates with each other as illustrated in FIG. 8. A support member 30 and the print element board 10 which are included in each ejection module 200 are provided with passages which supply the ink from the first passage member 50 to a print element 15 provided in the print element board 10. Further, the support member 30 and the print element board 10 are provided with passages which collect (re-circulate) a part or the entirety of the liquid supplied to the print element 15 to the first passage member 50.

Here, the common supply passage 211 of each color is connected to the negative pressure control unit 230 (the high pressure side) of corresponding color through the liquid supply unit 220 and the common collection passage 212 is connected to the negative pressure control unit 230 (the low pressure side) through the liquid supply unit 220. By the negative pressure control unit 230, a differential pressure (a difference in pressure) is generated between the common supply passage 211 and the common collection passage 212. For this reason, as illustrated in FIGS. 8 and 9, a flow is generated in order of the common supply passage 211 of each color, the individual supply passage 213, the print element board 10, the individual collection passage 214, and the common collection passage 212 inside the liquid ejection head of the embodiment having the passages connected to one another.

(Description of Ejection Module)

Figure 10A:
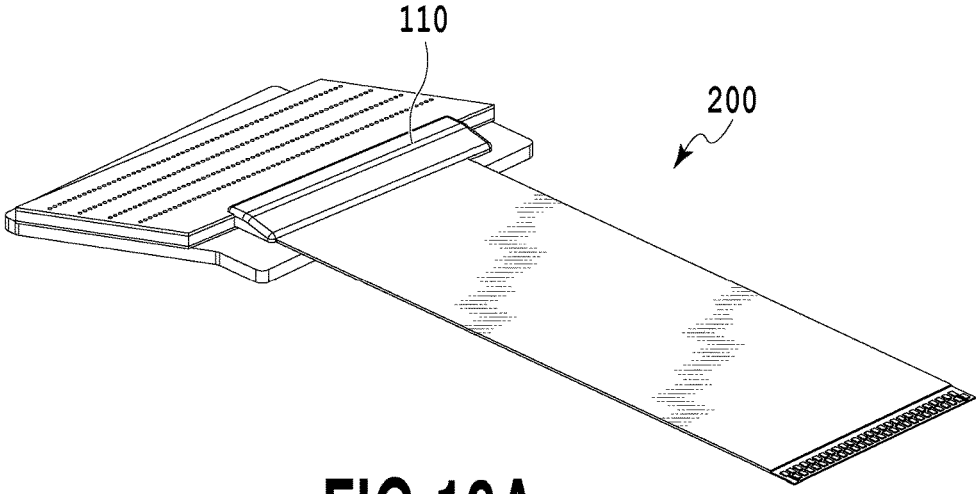
FIGS. 10A and 10B are perspective views illustrating one ejection module.
Figure 10B:
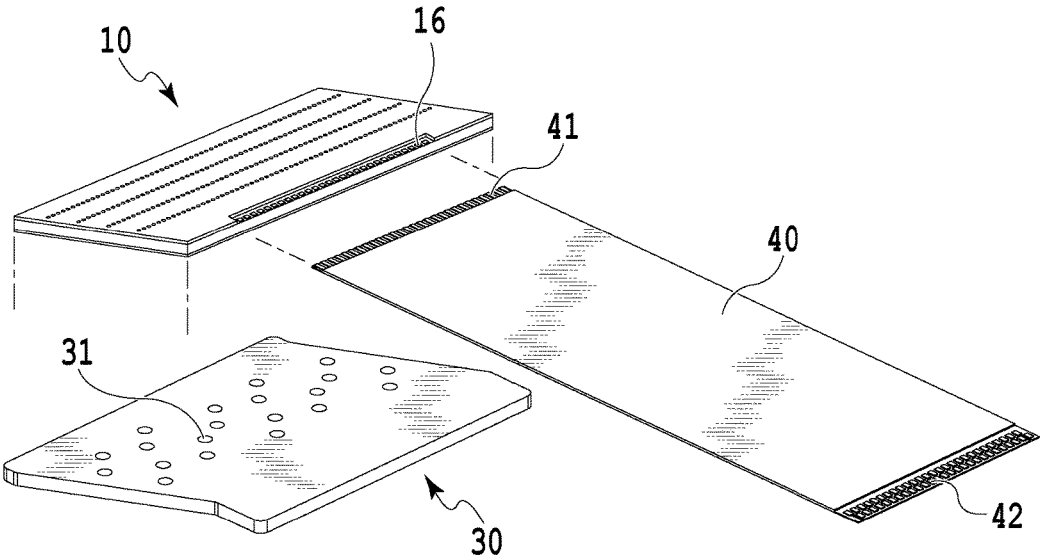

FIG. 10A is a perspective view illustrating one ejection module 200 and FIG. 10B is an exploded view thereof. As a method of manufacturing the ejection module 200, first, the print element board 10 and the flexible circuit board 40 are adhered onto the support member 30 provided with a liquid communication opening 31. Subsequently, a terminal 16 on the print element board 10 and a terminal 41 on the flexible circuit board 40 are electrically connected to each other by wire bonding and the wire bonded portion (the electrical connection portion) is sealed by the sealing member 110. A terminal 42 which is opposite to the print element board 10 of the flexible circuit board 40 is electrically connected to a connection terminal 93 (see FIG. 6) of the electric wiring board 90. Since the support member 30 serves as a support body that supports the print element board 10 and a passage member that fluid-communicates the print element board 10 and the passage member 210 to each other, it is desirable that the support member have high flatness and sufficiently high reliability while being bonded to the print element board. As a material, for example, alumina or resin is desirable.

(Description of Structure of Print Element Board)

Figure 11A:
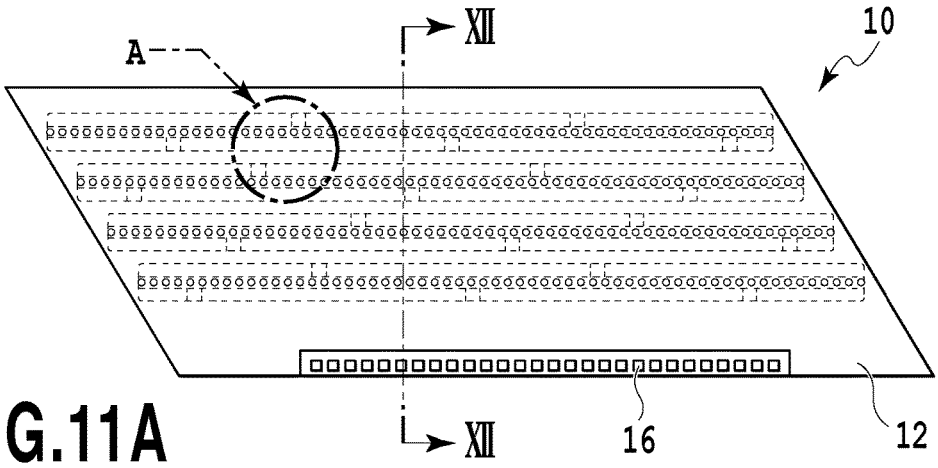
FIG. 11A is a plan view of a surface of a print element board on which ejection openings are formed.
Figure 11B:
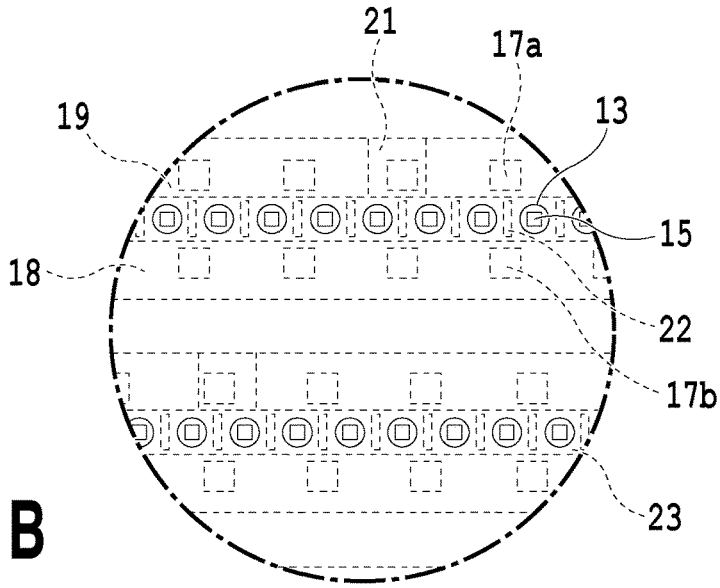
FIG. 11B is a partial enlargement view of the surface of a print element board.
Figure 11C:
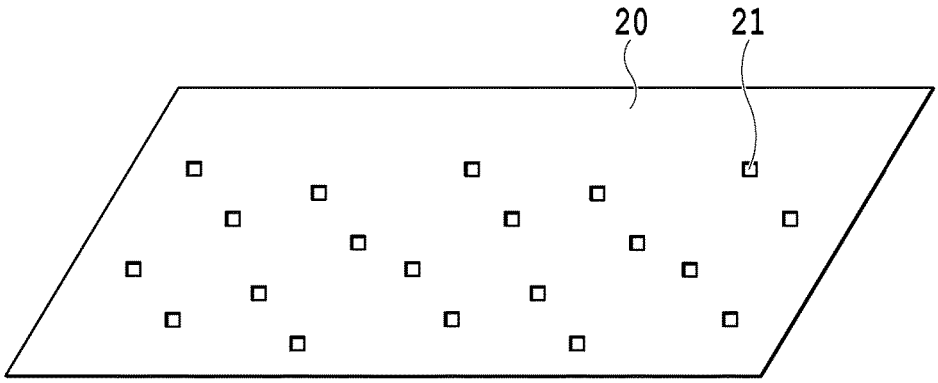
FIG. 11C is a view of opposite side of the surface of a print element board.

FIG. 11A is a top view illustrating a face provided with an ejection opening 13 in the print element board 10, FIG. 11B is an enlarged view of a part A of FIG. 11A, and FIG. 11C is a top view illustrating a rear face of FIG. 11A. Here, a configuration of the print element board 10 of the embodiment will be described. As illustrated in FIG. 11A, an ejection opening forming member 12 of the print element board 10 is provided with four ejection opening rows corresponding to different colors of inks. Further, the extension direction of the ejection opening rows of the ejection openings 13 will be referred to as an "ejection opening row direction". As illustrated in FIG. 11B, the print element 15 serving as an ejection energy generation element for ejecting the liquid by heat energy is disposed at a position corresponding to each ejection opening 13. A pressure chamber 23 provided inside the print element 15 is defined by a partition wall 22. The print element 15 is electrically connected to the terminal 16 by an electric wire (not illustrated) provided in the print element board 10. Then, the print element 15 boils the liquid while being heated on the basis of a pulse signal input from a control circuit of the printing apparatus 1000 via the electric wiring board 90 (see FIG. 6) and the flexible circuit board 40 (see FIG. 10B). The liquid is ejected from the ejection opening 13 by a foaming force caused by the boiling. As illustrated in FIG. 11B, a liquid supply path 18 extends at one side along each ejection opening row and a liquid collection path 19 extends at the other side along the ejection opening row. The liquid supply path 18 and the liquid collection path 19 are passages that extend in the ejection opening row direction provided in the print element board 10 and communicate with the ejection opening 13 through a supply opening 17*a* and a collection opening 17*b*.

As illustrated in FIG. 11C, a sheet-shaped lid member 20 is laminated on a rear face of a face provided with the ejection opening 13 in the print element board 10 and the lid member 20 is provided with a plurality of openings 21 communicating with the liquid supply path 18 and the liquid collection path 19. In the embodiment, the lid member 20 is provided with three openings 21 for each liquid supply path 18 and two openings 21 for each liquid collection path 19. As illustrated in FIG. 11B, openings 21 of the lid member 20 communicate with the communication openings 51 illustrated in FIG. 7(*a*). It is desirable that the lid member 20 have sufficient corrosion resistance for the liquid. From the viewpoint of preventing mixed color, the opening shape and the opening position of the opening need to have high accuracy. For this reason, it is desirable to form the opening 21 by using a photosensitive resin material or a silicon plate as a material of the lid member 20 through photolithography. In this way, the lid member 20 changes the pitch of the passages by the opening 21. Here, it is desirable to form the lid member by a film-shaped member with a thin thickness in consideration of pressure loss.

Figure 12:
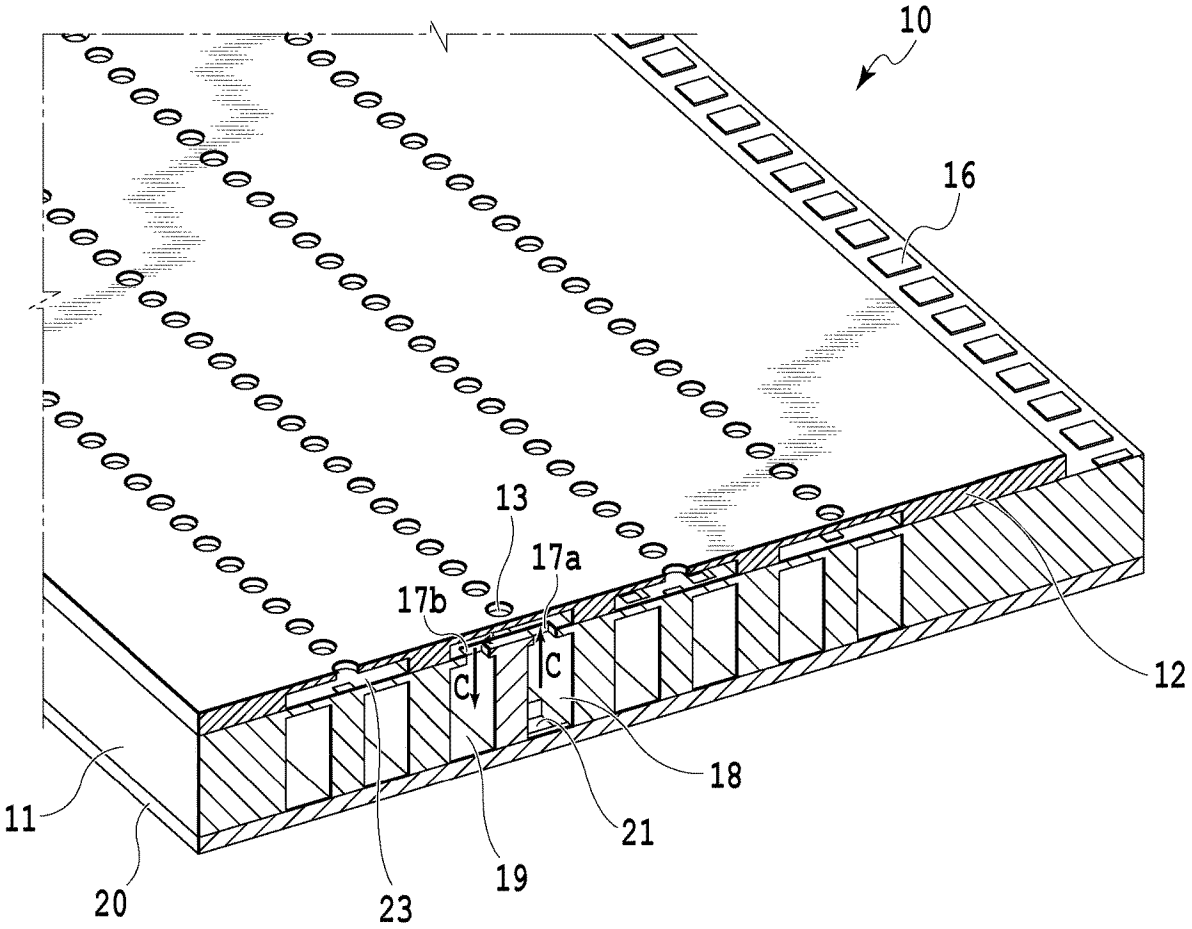
FIG. 12 is a perspective view illustrating cross-sections taken along a line XII-XII of FIG. 11A.

FIG. 12 is a perspective view illustrating cross-sections of the print element board 10 and the lid member 20 when taken along a line XII-XII of FIG. 11A. Here, a flow of the liquid inside the print element board 10 will be described. The lid member 20 serves as a lid that forms a part of walls of the liquid supply path 18 and the liquid collection path 19 formed in a substrate 11 of the print element board 10. The print element board 10 is formed by laminating the substrate 11 formed of Si and the ejection opening forming member 12 formed of photosensitive resin and the lid member 20 is bonded to a rear face of the substrate 11. One face of the substrate 11 is provided with the print element 15 (see FIG. 11B) and a rear face thereof is provided with grooves forming the liquid supply path 18 and the liquid collection path 19 extending along the ejection opening row. The liquid supply path 18 and the liquid collection path 19 which are formed by the substrate 11 and the lid member 20 are respectively connected to the common supply passage 211 and the common collection passage 212 inside each passage member 210 and a differential pressure is generated between the liquid supply path 18 and the liquid collection path 19. When the liquid is ejected from the ejection opening 13 to print an image, the liquid inside the liquid supply path 18 provided inside the substrate 11 at the ejection opening not ejecting the liquid flows toward the liquid collection path 19 through the supply opening 17*a*, the pressure chamber 23, and the collection opening 17*b* by the differential pressure (see an arrow C of FIG. 12). By the flow, foreign materials, bubbles, and thickened ink produced by the evaporation from the ejection opening 13 in the ejection opening 13 or the pressure chamber 23 not involved with a printing operation can be collected by the liquid collection path 19. Further, the thickening of the ink of the ejection opening 13 or the pressure chamber 23 can be suppressed. The liquid which is collected to the liquid collection path 19 is collected in order of the communication opening 51 (see FIG. 7(*a*)) inside the passage member 210, the individual collection passage 214, and the common collection passage 212 through the opening 21 of the lid member 20 and the liquid communication opening 31 (see FIG. 10B) of the support member 30. Then, the liquid is collected by the collection path of the printing apparatus 1000. That is, the liquid supplied from the printing apparatus body to the liquid ejection head 3 flows in the following order to be supplied and collected.

First, the liquid flows from the liquid connection portion 111 of the liquid supply unit 220 into the liquid ejection head 3. Then, the liquid is sequentially supplied through the joint rubber 100, the communication opening 72 and the common passage groove 71 provided in the third passage member, the common passage groove 62 and the communication opening 61 provided in the second passage member, and the individual passage groove 52 and the communication opening 51 provided in the first passage member. Subsequently, the liquid is supplied to the pressure chamber 23 while sequentially passing through the liquid communication opening 31 provided in the support member 30, the opening 21 provided in the lid member 20, and the liquid supply path 18 and the supply opening 17*a* provided in the substrate 11. In the liquid supplied to the pressure chamber 23, the liquid which is not ejected from the ejection opening 13 sequentially flows through the collection opening 17*b* and the liquid collection path 19 provided in the substrate 11, the opening 21 provided in the lid member 20, and the liquid communication opening 31 provided in the support member 30. Subsequently, the liquid sequentially flows through the communication opening and the individual passage groove 52 provided in the first passage member, the communication opening 61 and the common passage groove 62 provided in the second passage member, the common passage groove 71 and the communication opening 72 provided in the third passage member 70, and the joint rubber 100. Then, the liquid flows from the liquid connection portion 111 provided in the liquid supply unit 220 to the outside of the liquid ejection head 3.

In the first circulation configuration illustrated in FIG. 2, the liquid which flows from the liquid connection portion 111 is supplied to the joint rubber 100 through the negative pressure control unit 230. Further, in the second circulation configuration illustrated in FIG. 3, the liquid which is collected from the pressure chamber 23 passes through the joint rubber 100 and flows from the liquid connection portion 111 to the outside of the liquid ejection head through the negative pressure control unit 230. The entire liquid which flows from one end of the common supply passage 211 of the liquid ejection unit 300 is not supplied to the pressure chamber 23 through the individual supply passage 213*a*. That is, the liquid may flow from the other end of the common supply passage 211 to the liquid supply unit 220 while not flowing into the individual supply passage 213*a* by the liquid which flows from one end of the common supply passage 211. In this way, since the path is provided so that the liquid flows therethrough without passing through the print element board 10, the reverse flow of the circulation flow of the liquid can be suppressed even in the print element board 10 including the large passage with a small flow resistance as in the embodiment. In this way, since the thickening of the liquid in the vicinity of the ejection opening or the pressure chamber 23 can be suppressed in the liquid ejection head 3 of the embodiment, a slippage or a non-ejection can be suppressed. As a result, a high-quality image can be printed.

(Description of Positional Relation Among Print Element) Boards

Figure 13:
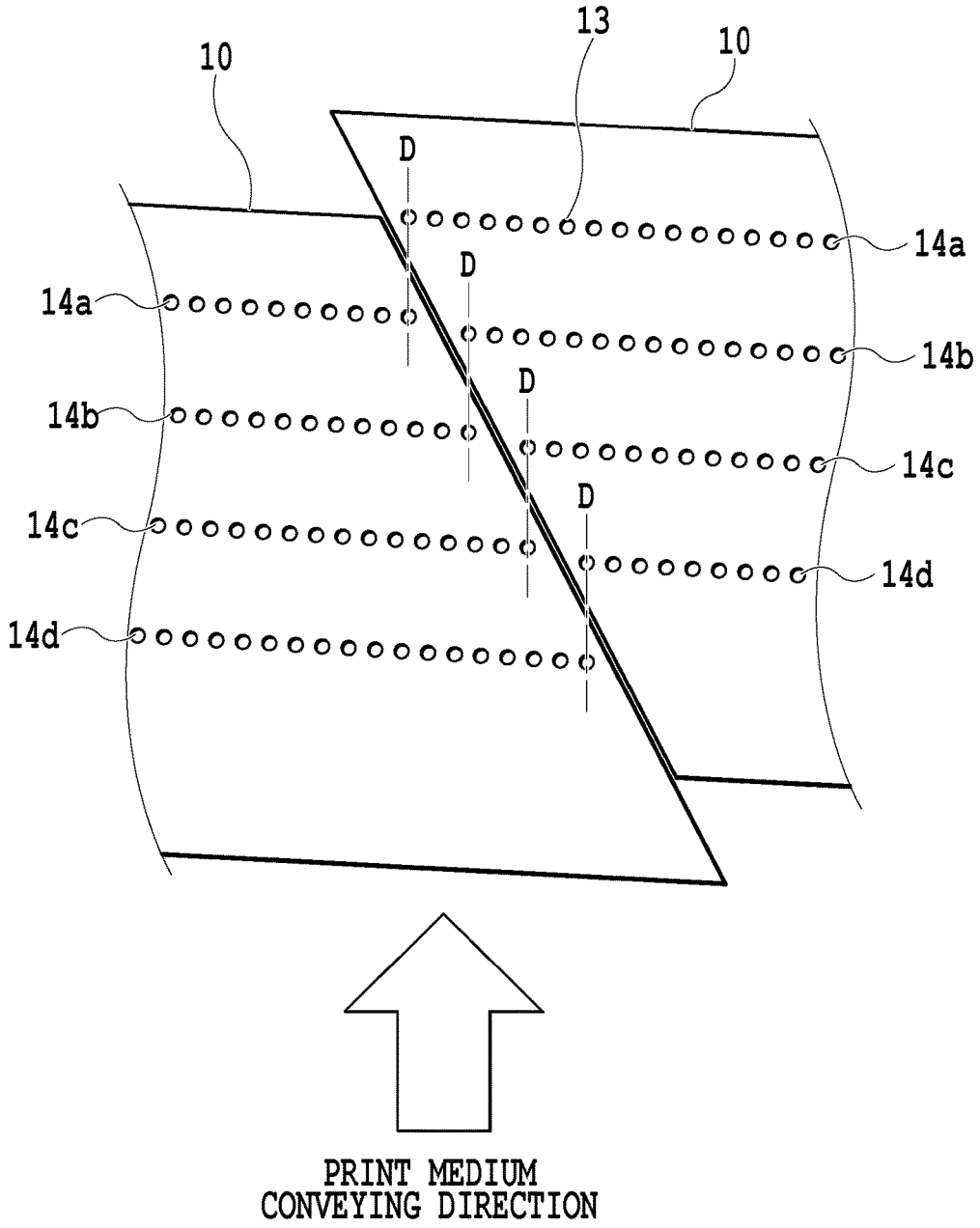
FIG. 13 is a partially enlarged plan view of an adjacent portion of adjacent two ejection modules of the print element board.

FIG. 13 is a partially enlarged top view illustrating an adjacent portion of the print element board in two adjacent ejection modules 200. In the embodiment, a substantially parallelogram print element board is used. Ejection opening rows (14*a* to 14*d*) having the ejection openings 13 arranged in each print element board 10 are disposed to be inclined while having a predetermined angle with respect to the longitudinal direction of the liquid ejection head 3. Then, the ejection opening row at the adjacent portion between the print element boards 10 is formed such that at least one ejection opening overlaps in the print medium conveying direction. In FIG. 13, two ejection openings on a line D overlap each other. With such an arrangement, even when a position of the print element board 10 is slightly deviated from a predetermined position, black streaks or missing of a print image cannot be seen by a driving control of the overlapping ejection openings. Even when the print element boards 10 are disposed in a straight linear shape (an in-line shape) instead of a zigzag shape, black streaks or missing at the connection portion between the print element boards 10 can be handled while an increase in the length of the liquid ejection head 3 in the print medium conveying direction is suppressed by the configuration illustrated in FIG. 13. Further, in the embodiment, a principal plane of the print element board has a parallelogram shape, but the invention is not limited thereto. For example, even when the print element boards having a rectangular shape, a trapezoid shape, and the other shapes are used, the configuration of the invention can be desirably used.

(Ink Jet Printing Apparatus of Second Embodiment)

Hereinafter, configurations of an inkjet printing apparatus 2000 and a liquid ejection head 2003 according to a second embodiment of the invention will be described with reference to the drawings. In the description below, only a difference from the first embodiment will be described and a description of the same components as those of the first embodiment will be omitted.

(Description of Inkjet Printing Apparatus)

Figure 21:
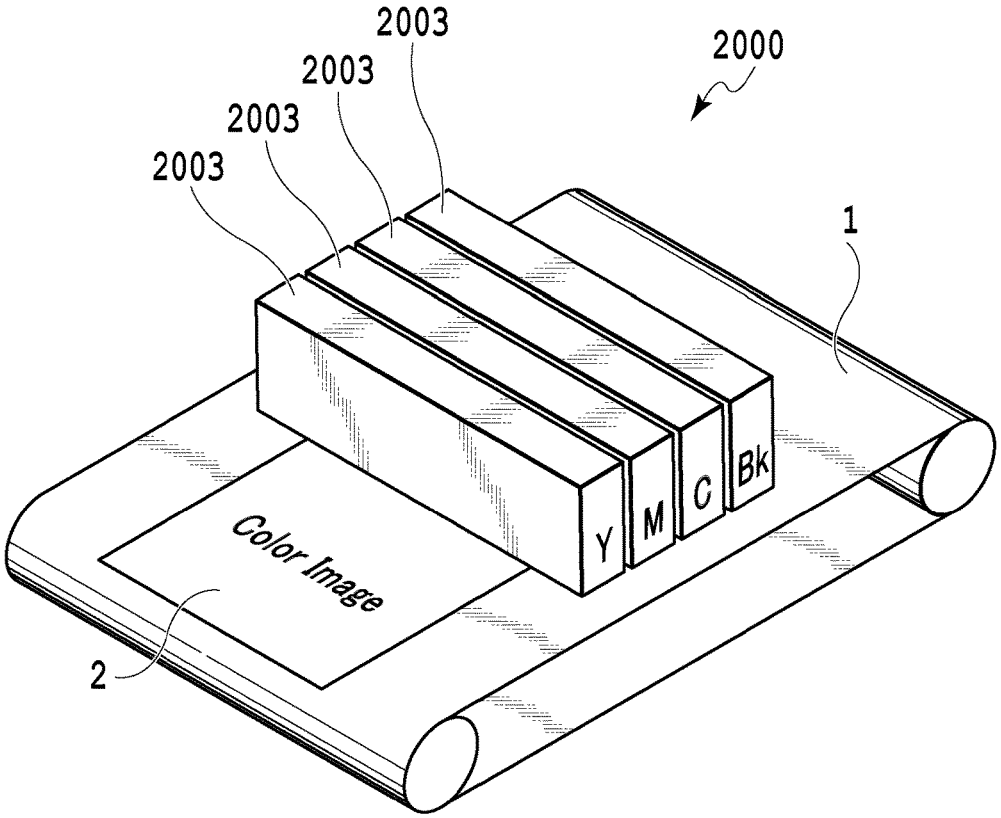
FIG. 21 is a perspective view illustrating a second embodiment of an inkjet printing apparatus according to the embodiment.

FIG. 21 is a diagram illustrating the inkjet printing apparatus 2000 according to the embodiment used to eject the liquid. The printing apparatus 2000 of the embodiment is different from the first embodiment in that a full color image is printed on the print medium by a configuration in which four monochromic liquid ejection heads 2003 respectively corresponding to the inks of cyan C, magenta M, yellow Y, and black K are disposed in parallel. In the first embodiment, the number of the ejection opening rows which can be used for one color is one. However, in the embodiment, the number of the ejection opening rows which can be used for one color is twenty. For this reason, when print data is appropriately distributed to a plurality of ejection opening rows to print an image, an image can be printed at a higher speed. Further, even when there are the ejection openings that do not eject the liquid, the liquid is ejected complementarily from the ejection openings of the other rows located at positions corresponding to the non-ejection openings in the print medium conveying direction. The reliability is improved and thus a commercial image can be appropriately printed. Similarly to the first embodiment, the supply system, the buffer tank 1003 (see FIGS. 2 and 3), and the main tank 1006 (see FIGS. 2 and 3) of the printing apparatus 2000 are fluid-connected to the liquid ejection heads 2003. Further, an electrical control unit which transmits power and ejection control signals to the liquid ejection head 2003 is electrically connected to the liquid ejection heads 2003.

(Description of Circulation Path)

Similarly to the first embodiment, the first and second circulation configurations illustrated in FIG. 2 or can be used as the liquid circulation configuration between the printing apparatus 2000 and the liquid ejection head 2003.

(Description of Structure of Liquid Ejection Head)

Figure 14A:
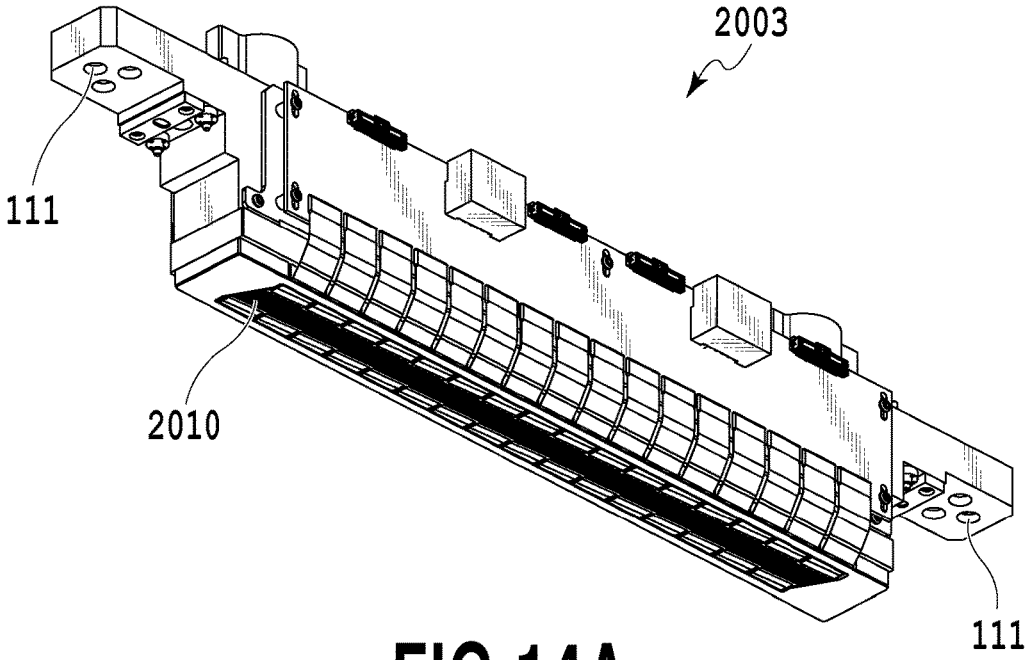
FIGS. 14A and 14B are perspective views illustrating the liquid ejection head according to other example of the embodiment.
Figure 14B:
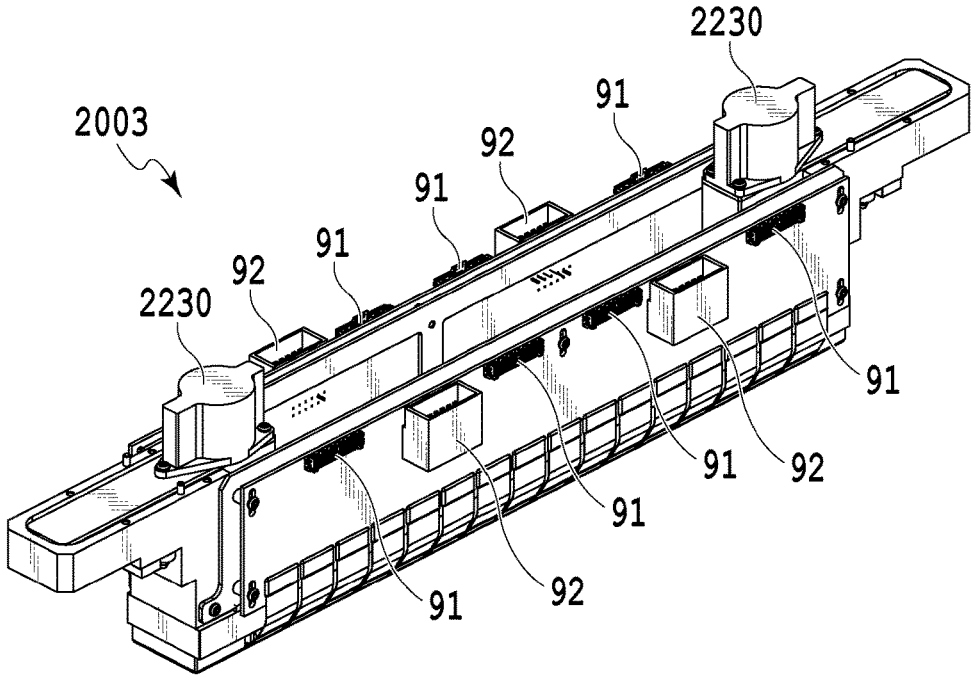

FIGS. 14A and 14B are perspective views illustrating the liquid ejection head 2003 according to the embodiment. Here, a structure of the liquid ejection head 2003 according to the embodiment will be described. The liquid ejection head 2003 is an inkjet line type (page wide type) print head which includes sixteen print element boards 2010 arranged linearly in the longitudinal direction of the liquid ejection head 2003 and can print an image by one kind of liquid. Similarly to the first embodiment, the liquid ejection head 2003 includes the liquid connection portion 111, the signal input terminal 91, and the power supply terminal 92. However, since the liquid ejection head 2003 of the embodiment includes many ejection opening rows compared with the first embodiment, the signal input terminal 91 and the power supply terminal 92 are disposed at both sides of the liquid ejection head 2003. This is because a decrease in voltage or a delay in transmission of a signal caused by the wiring portion provided in the print element board 2010 needs to be reduced.

Figure 15:
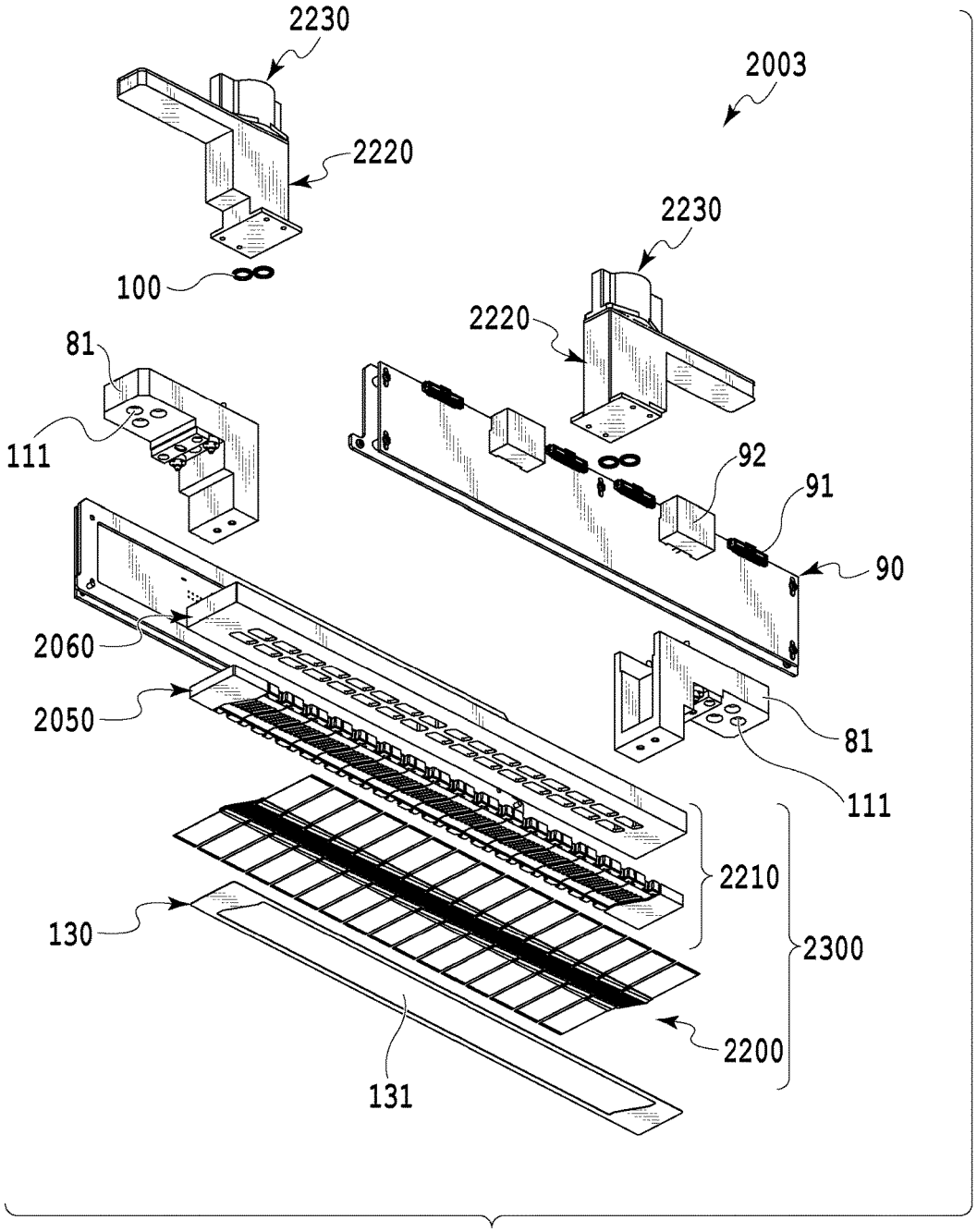
FIG. 15 is a perspective exploded view illustrating the liquid ejection head according to other example of the embodiment.

FIG. 15 is an oblique exploded view illustrating the liquid ejection head 2003 and components or units constituting the liquid ejection head 2003 according to the functions thereof. The function of each of units and members or the liquid flow sequence inside the liquid ejection head is basically similar to that of the first embodiment, but the function of guaranteeing the rigidity of the liquid ejection head is different. In the first embodiment, the rigidity of the liquid ejection head is mainly guaranteed by the liquid ejection unit support portion 81, but in the liquid ejection head 2003 of the second embodiment, the rigidity of the liquid ejection head is guaranteed by a second passage member 2060 included in a liquid ejection unit 2300. The liquid ejection unit support portion 81 of the embodiment is connected to both ends of the second passage member 2060 and the liquid ejection unit 2300 is mechanically connected to a carriage of the printing apparatus 2000 to position the liquid ejection head 2003. The electric wiring board 90 and a liquid supply unit 2220 including a negative pressure control unit 2230 are connected to the liquid ejection unit support portion 81. Each of two liquid supply units 2220 includes a filter (not illustrated) built therein.

Two negative pressure control units 2230 are set to control a pressure at different and relatively high and low negative pressures. Further, as in FIGS. 14B and 15, when the negative pressure control units 2230 at the high pressure side and the low pressure side are provided at both ends of the liquid ejection head 2003, the flows of the liquid in the common supply passage and the common collection passage extending in the longitudinal direction of the liquid ejection head 2003 face each other. In such a configuration, a heat exchange between the common supply passage and the common collection passage is promoted and thus a difference in temperature inside two common passages is reduced. Accordingly, a difference in temperature of the print element boards 2010 provided along the common passage is reduced. As a result, there is an advantage that unevenness in printing is not easily caused by a difference in temperature.

Next, a detailed configuration of a passage member 2210 of the liquid ejection unit 2300 will be described. As illustrated in FIG. 15, the passage member 2210 is obtained by laminating a first passage member 2050 and a second passage member 2060 and distributes the liquid supplied from the liquid supply unit 2220 to ejection modules 2200. The passage member 2210 serves as a passage member that returns the liquid re-circulated from the ejection module 2200 to the liquid supply unit 2220. The second passage member 2060 of the passage member 2210 is a passage member having a common supply passage and a common collection passage formed therein and improving the rigidity of the liquid ejection head 2003. For this reason, it is desirable that a material of the second passage member 2060 have sufficient corrosion resistance for the liquid and high mechanical strength. Specifically, SUS, Ti, or alumina can be used.

Figure 16:
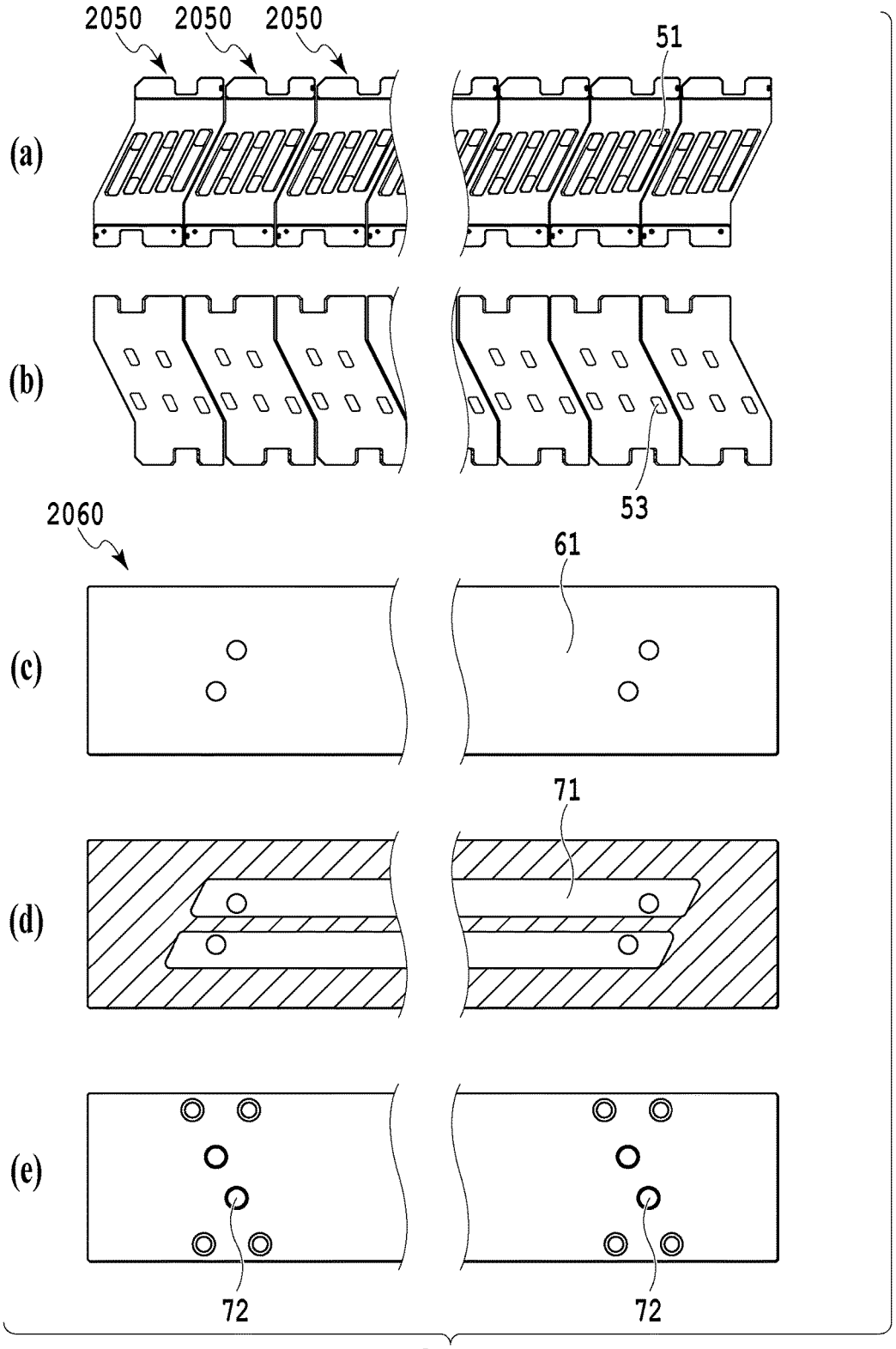
FIG. 16 is a diagram illustrating passage members making up the liquid ejection head according to other example of the embodiment.

FIG. 16(*a*) is a diagram illustrating a face onto which the ejection module 2200 is mounted in the first passage member 2050 and FIG. 16(*b*) is a diagram illustrating a rear face thereof and a face contacting the second passage member 2060. Differently from the first embodiment, the first passage member 2050 of the embodiment has a configuration in which a plurality of members are disposed adjacently to respectively correspond to the ejection modules 2200. By employing such a split structure, a plurality of modules can be arranged to correspond to a length of the liquid ejection head 2003. Accordingly, this structure can be appropriately used particularly in a relatively long liquid ejection head corresponding to, for example, a sheet having a size of B2 or more. As illustrated in FIG. 16(*a*), the communication opening 51 of the first passage member 2050 fluid-communicates with the ejection module 2200. As illustrated in FIG. 16(*b*), the individual communication opening 53 of the first passage member 2050 fluid-communicates with the communication opening 61 of the second passage member 2060. FIG. 16(*c*) illustrates a contact face of the second passage member 60 with respect to the first passage member 2050, FIG. 16(*d*) illustrates a cross-section of a center portion of the second passage member 60 in the thickness direction, and FIG. 16(*e*) is a diagram illustrating a contact face of the second passage member 2060 with respect to the liquid supply unit 2220. The function of the communication opening or the passage of the second passage member 2060 is similar to each color of the first embodiment. The common passage groove 71 of the second passage member 2060 is formed such that one side thereof is a common supply passage 2211 illustrated in FIG. 17 and the other side thereof is a common collection passage 2212. These passages are respectively provided along the longitudinal direction of the liquid ejection head 2003 so that the liquid is supplied from one end thereof to the other end thereof. The embodiment is different from the first embodiment in that the liquid flow directions in the common supply passage 2211 and the common collection passage 2212 are opposite to each other.

Figure 17:
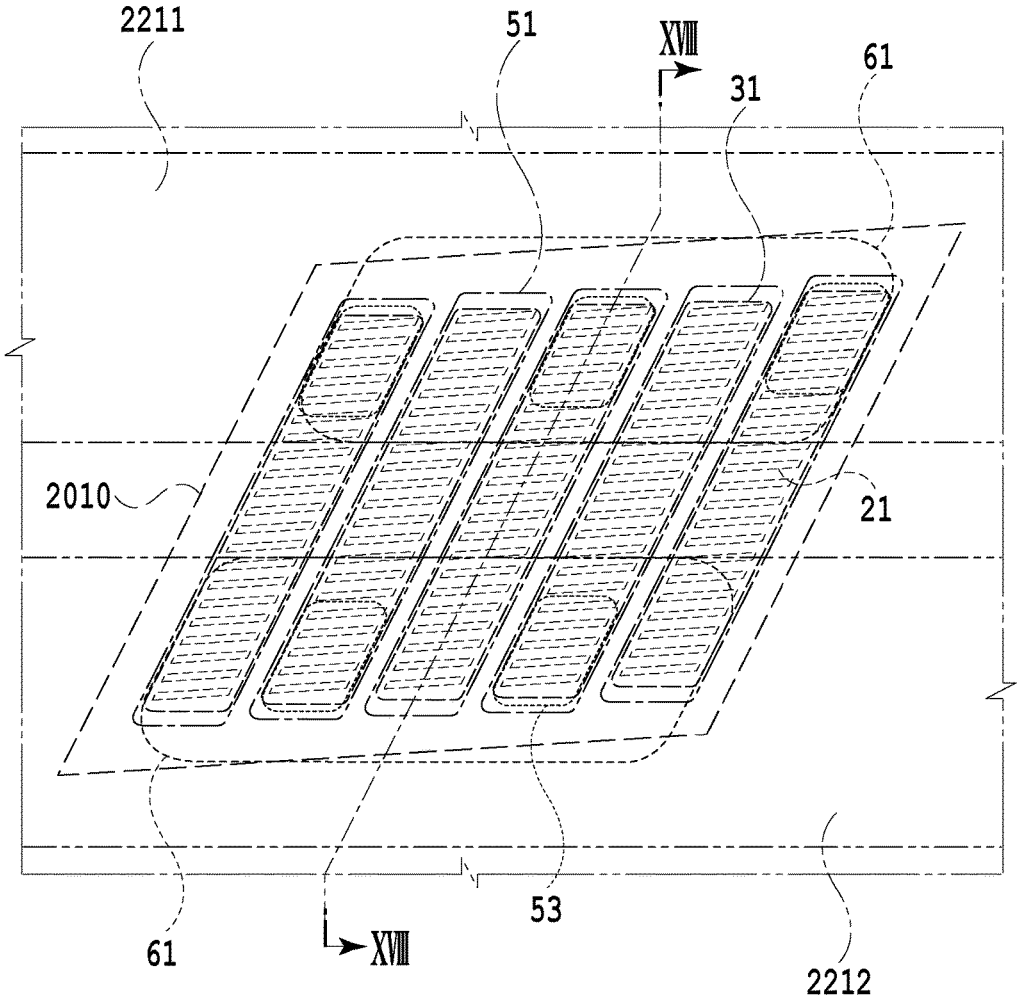
FIG. 17 is a transparent view illustrating a liquid connection relation between the print element board and the passage member in the liquid ejection head according to other example of the embodiment.

FIG. 17 is a perspective view illustrating a liquid connection relation between the print element board 2010 and the passage member 2210. A pair of the common supply passage 2211 and the common collection passage 2212 extending in the longitudinal direction of the liquid ejection head 2003 is provided inside the passage member 2210. The communication opening 61 of the second passage member 2060 is connected to the individual communication opening 53 of the first passage member 2050 so that both positions match each other and the liquid supply passage communicating with the communication opening 51 of the first passage member 2050 through the communication opening from the common supply passage 2211 of the second passage member 2060 is formed. Similarly, the liquid the supply path communicating with the communication opening 51 of the first passage member 2050 through the common collection passage 2212 from the communication opening 72 of the second passage member 2060 is also formed.

Figure 18:
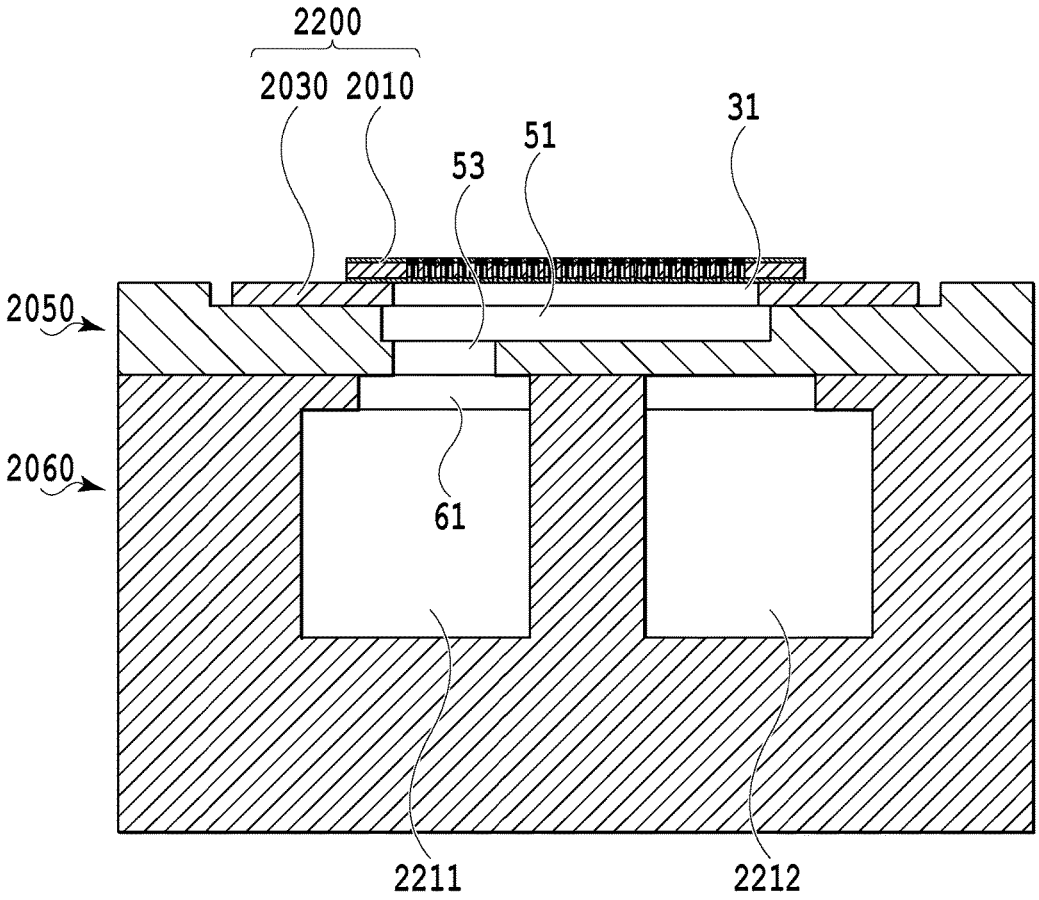
FIG. 18 is a cross-sectional view taken along a line XVIII-XVIII of FIG. 17.

FIG. 18 is a cross-sectional view taken along a line XVIII-XVIII of FIG. 17. The common supply passage 2211 is connected to the ejection module 2200 through the communication opening 61, the individual communication opening 53, and the communication opening 51. Although not illustrated in FIG. 18, it is obvious that the common collection passage 2212 is connected to the ejection module 2200 by the same path in a different cross-section in FIG. 17. Similarly to the first embodiment, each of the ejection module 2200 and the print element board 2010 is provided with a passage communicating with each ejection opening and thus a part or the entirety of the supplied liquid can be re-circulated while passing through the ejection opening that does not perform the ejection operation. Further, similarly to the first embodiment, the common supply passage 2211 is connected to the negative pressure control unit 2230 (the high pressure side) and the common collection passage 2212 is connected to the negative pressure control unit 2230 (the low pressure side) through the liquid supply unit 2220. Thus, a flow is formed so that the liquid flows from the common supply passage 2211 to the common collection passage 2212 through the pressure chamber of the print element board 2010 by the differential pressure.

(Description of Ejection Module)

Figure 19A:
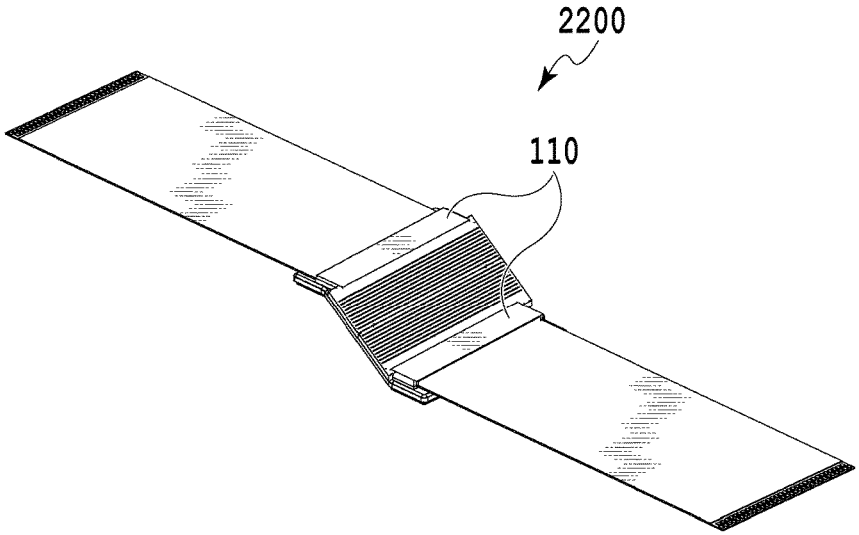
FIGS. 19A and 19B are a perspective view and an exploded view respectively illustrating ejection modules of the liquid ejection head according to other example of the embodiment.
Figure 19B:
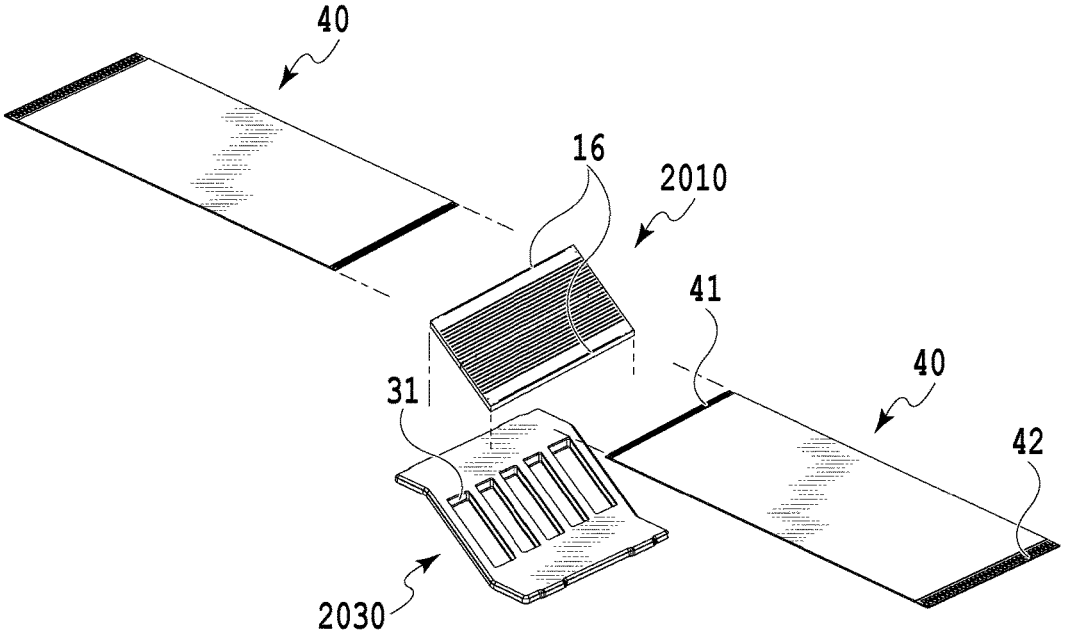

FIG. 19A is a perspective view illustrating one ejection module 2200 and FIG. 19B is an exploded view thereof. A difference from the first embodiment is that the terminals 16 are respectively disposed at both sides (the long side portions of the print element board 2010) in the ejection opening row directions of the print element board 2010. Accordingly, two flexible circuit boards 40 electrically connected to the print element board 2010 are disposed for each print element board 2010. Since the number of the ejection opening rows provided in the print element board 2010 is twenty, the ejection opening rows are more than eight ejection opening rows of the first embodiment. Here, since a maximal distance from the terminal 16 to the print element is shortened, a decrease in voltage or a delay of a signal generated in the wiring portion inside the print element board 2010 is reduced. Further, the liquid communication opening 31 of the support member 2030 is opened along the entire ejection opening row provided in the print element board 2010. The other configurations are similar to those of the first embodiment.

(Description of Structure of Print Element Board)

Figure 20:
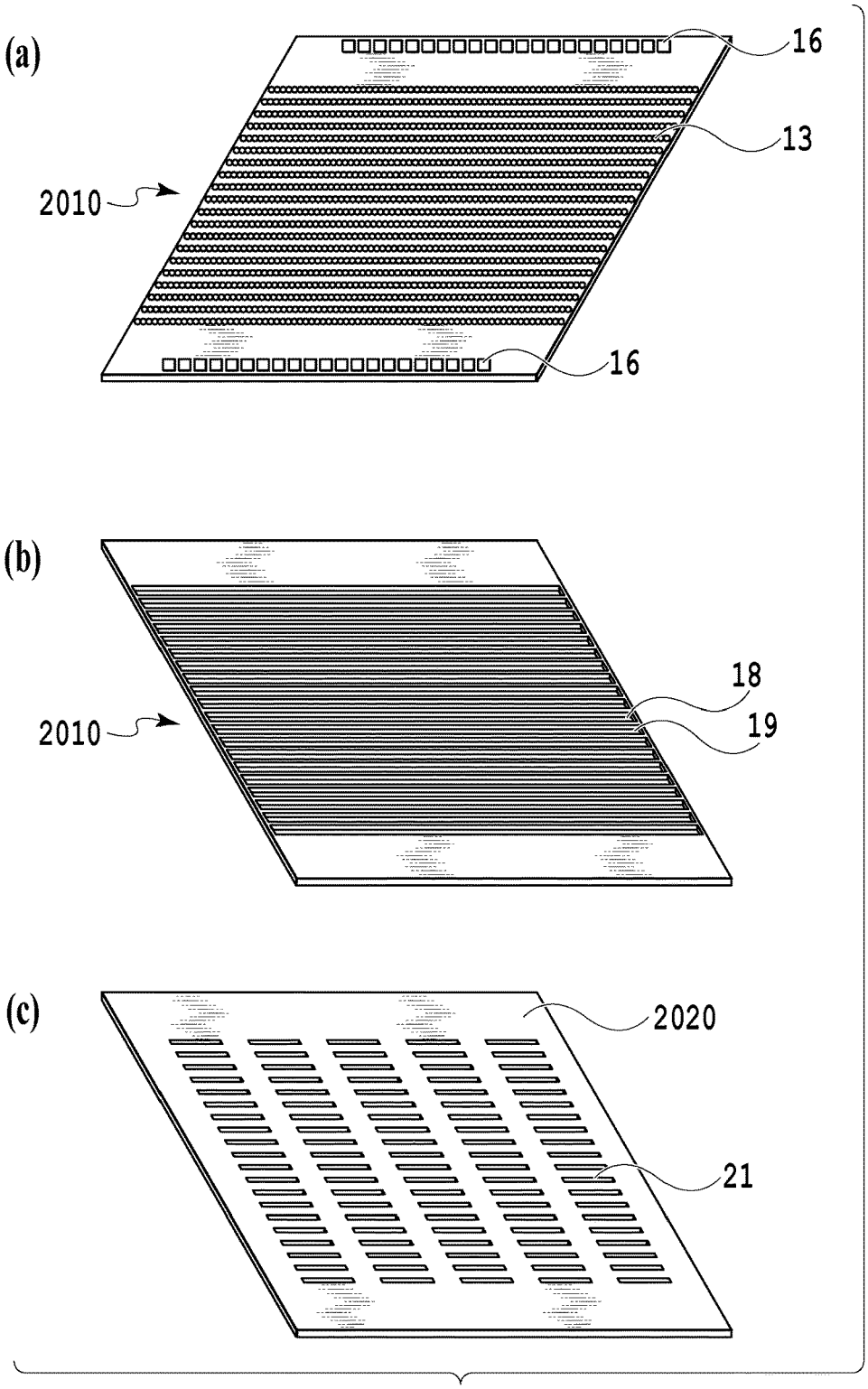
FIG. 20 is a schematic diagram illustrating a surface of the print element board on which ejection openings are arranged, a surface of the print element board in a condition that a cover plate is removed from an opposite side of the print element board, and an opposite side surface to the surface on which ejection openings are arranged.

FIG. 20(*a*) is a schematic diagram illustrating a face on which the ejection opening 13 is disposed in the print element board 2010 and FIG. 20(*c*) is a schematic diagram illustrating a rear face of the face of FIG. 20(*a*). FIG. 20(*b*) is a schematic diagram illustrating a face of the print element board 2010 when a lid member 2020 provided in the rear face of the print element board 2010 in FIG. 20(*c*) is removed. As illustrated in FIG. 20(*b*), the liquid supply path 18 and the liquid collection path 19 are alternately provided along the ejection opening row direction at the rear face of the print element board 2010. The number of the ejection opening rows is larger than that of the first embodiment. However, a basic difference from the first embodiment is that the terminal 16 is disposed at both sides of the print element board in the ejection opening row direction as described above. A basic configuration is similar to the first embodiment in that a pair of the liquid supply path 18 and the liquid collection path 19 is provided in each ejection opening row and the cover plate 2020 is provided with the opening 21 communicating with the liquid communication opening 31 of the support member 2030.

The description of the above-described application example does not limit the scope of the invention. As an example, in the application example, a thermal type has been described in which bubbles are generated by a heating element to eject the liquid. However, the invention can be also applied to the liquid ejection head which employs a piezo type and the other various liquid ejection types.

In the application example, the inkjet printing apparatus (the printing apparatus) has been described in which the liquid such as ink is circulated between the tank and the liquid ejection head, but the other application examples may be also used. In the other application examples, for example, a configuration may be employed in which the ink is not circulated and two tanks are provided at the upstream side and the downstream side of the liquid ejection head so that the ink flows from one tank to the other tank. In this way, the ink inside the pressure chamber may flow.

In the application example, an example of using a so-called page wide type head having a length corresponding to the width of the print medium has been described, but the invention can be also applied to a so-called serial type liquid ejection head which prints an image on the print medium while scanning the print medium. As the serial type liquid ejection head, for example, the liquid ejection head may be equipped with a printing element board ejecting black ink and a printing element board ejecting color ink, but the invention is not limited thereto. That is, a liquid ejection head which is shorter than the width of the print medium and includes a plurality of printing element boards disposed so that the ejection openings overlap each other in the ejection opening row direction may be provided and the print medium may be scanned by the liquid ejection head.

(First Embodiment)

A first embodiment of the invention relates to a configuration for controlling of a temperature of the liquid ejection head which performs circulation of ink for the respective ejection openings described above with reference to FIGS. 1 to 21.

As described in the foregoing, in the liquid ejection head, heat is generated due to an ejection operation of ejection liquid by driving the heating element, which leads to a rise in temperature of the print element board. In addition, a temperature of the liquid ejection head may rise due to temperature control of the liquid ejection head per se. In such an environment in which the temperatures rise, liquid (ink), a temperature of which is relatively low, is supplied to the liquid supply path 18 illustrated in FIGS. 11A to 11C, FIG. 12, etc. through the opening 21. In addition, as described in the foregoing, in the present embodiment, three openings 21 are provided for one liquid supply path 18. For this reason, an ejection opening disposed around the opening 21 and an ejection opening disposed to be separated from the opening 21 are present among a plurality of ejection openings 13 arranged along the liquid supply path 18. In this case, liquid, a temperature of which is relatively low, is supplied to (the pressure chamber 23 of) the ejection opening disposed around the opening 21. In addition, liquid, which is heated by heat transfer from the print element board while the liquid flows from the opening 21 to the ejection opening disposed to be separated from the opening 21, is supplied to the ejection opening disposed to be separated from the opening 21. As a result, the temperature of the liquid varies along the ejection opening rows, and thus the amount of liquid ejected from the respective ejection openings may vary, which corresponds to unevenness in density of an image in an apparatus that prints the image using ink. In the present embodiment, the variation in the temperature of the liquid along the ejection opening rows is suppressed by disposing a heater in the print element board.

Figure 22A:
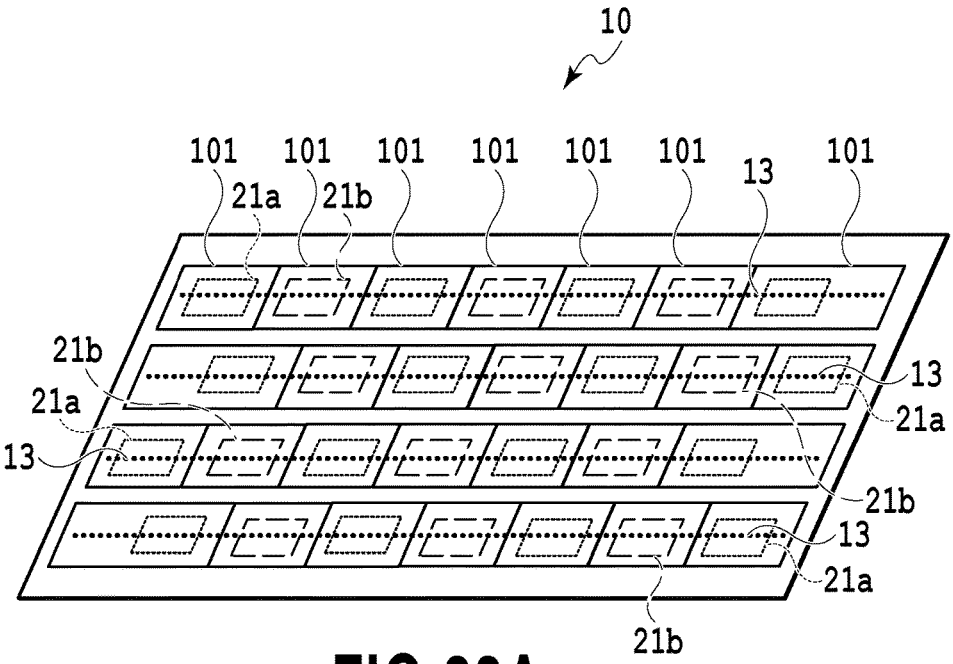
FIGS. 22A and 22B are diagrams schematically illustrating a positional relation among an opening, a heater, and a temperature sensor in a print element board according to a first embodiment of the invention.
Figure 22B:
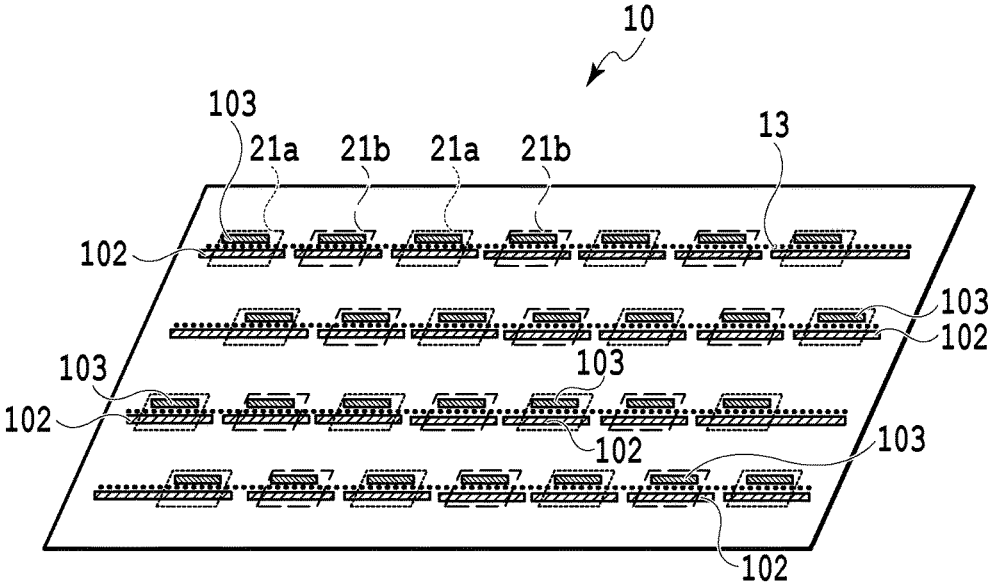

FIGS. 22A and 22B are diagrams schematically illustrating a relation among the opening 21, the heater, and a temperature sensor in a print element board according to the first embodiment of the invention. FIG. 22A illustrates an arrangement of the openings 21 along an ejection opening row in which the ejection openings 13 are arrayed in the print element board 10. As illustrated in FIGS. 11A to 11C and FIG. 12, the openings 21 are positioned in both the liquid supply path 18 and the liquid collection path 19 that extend at both sides along the ejection opening row respectively. However, FIGS. 22A and 22B illustrate that the openings are arranged in a straight line shape for simplification of illustration and description. In this regard, an opening 21*a* is disposed in the liquid supply path 18, and an opening 21*b* is disposed in the liquid collection path 19. In addition, sizes of the respective openings are schematically illustrated unlike those illustrated in FIGS. 11A to 11C, etc. Further, the number of openings is illustrated without being restricted to three for one liquid supply path 18 and to two for one liquid collection path 19 as described above. FIG. 22B illustrates a positional relation between a heater 102 (and a heater row) and a temperature sensor 103 (and a temperature sensor row) with respect to positions of the opening 21*a* and the opening 21*b* along the ejection opening row. It should be noted that the numbers of the opening 21*a* and 21*b* are examples and two openings 21*a* and one opening 21*b* may correspond to one liquid supply path 18 and one liquid collection path 19 respectively. In addition, the numbers of the opening 21*a* and 21*b* may be the same as each other.

In the present embodiment, as illustrated in FIG. 22A, an area around the opening 21*a* or the opening 21*b* is set to a temperature adjustment area 101. As illustrated in FIG. 22B, the temperature sensor 103 and the temperature adjustment heater 102 are arranged in each of the areas. Specifically, in FIG. 11B, the temperature adjustment heater 102 and the temperature sensor 103 are provided at a distance in which operations thereof do not affect each other around the printing element 15 that is the heating element for ejecting liquid. Specific examples of the temperature sensor may include a diode sensor, etc. In addition, the temperature sensor 103 has a shape which is long in a direction of the ejection opening row in the figure. However, the shape may correspond to a circle, a square, etc.

When the temperature sensor 103 corresponding to each area 101 detects a temperature less than or equal to a certain threshold temperature, the heater 102 present in the area is driven to perform heating. On the other hand, when a temperature higher than the threshold is detected, heating by the heater 102 is stopped. In this way, ink, a temperature of which is relatively low, flows in around the opening 21*a* at which ink flows into the print element board, and thus the corresponding temperature sensor 103 detects a relatively low temperature. As a result, heating by the corresponding heater 102 is performed at a high frequency or for a long time by temperature control. On the other hand, since a temperature of ink around the opening 21*b* at which ink flows out is relatively high, the corresponding temperature sensor 103 detects a relatively high temperature. As a result, heating by the corresponding heater 102 is performed at a low frequency or in a short time, or heating is not performed by temperature control. As a result, it is possible to suppress a variation in temperature of ink along the ejection opening row which may occur due to ink circulation. In addition, in the present embodiment, the number of openings may be the same as the number of temperature control areas, and the number of temperature sensors or temperature adjustment heaters may be small.

Figure 23A:
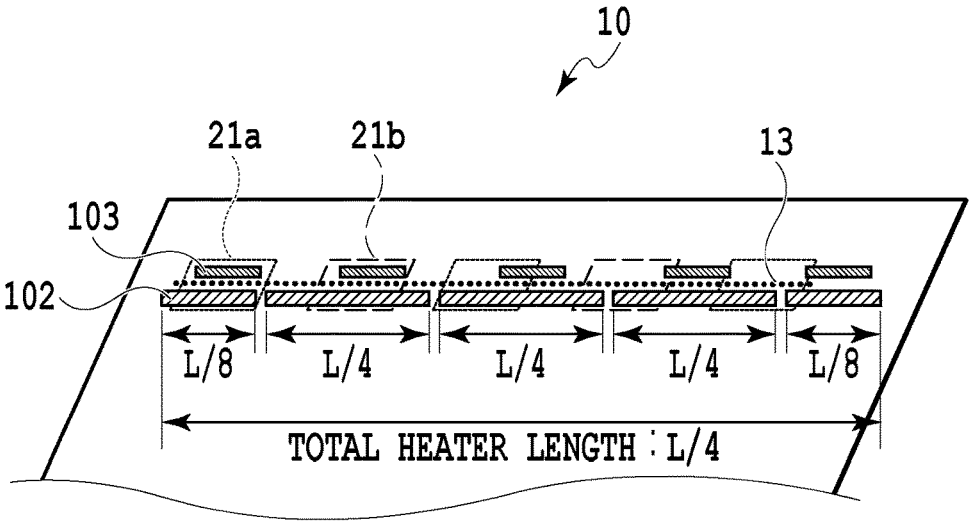
FIGS. 23A and 23B are diagrams illustrating a positional relation among an opening, a heater, and a temperature sensor for a simulation according to the first embodiment.
Figure 23B:
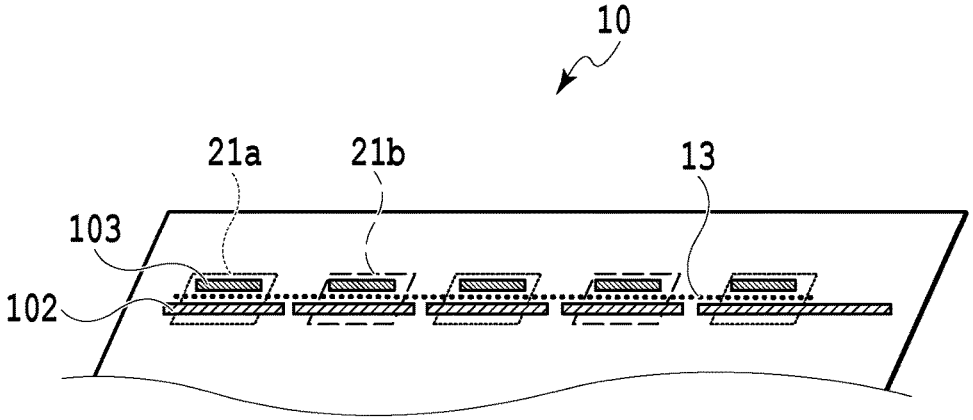
Figure 24A:
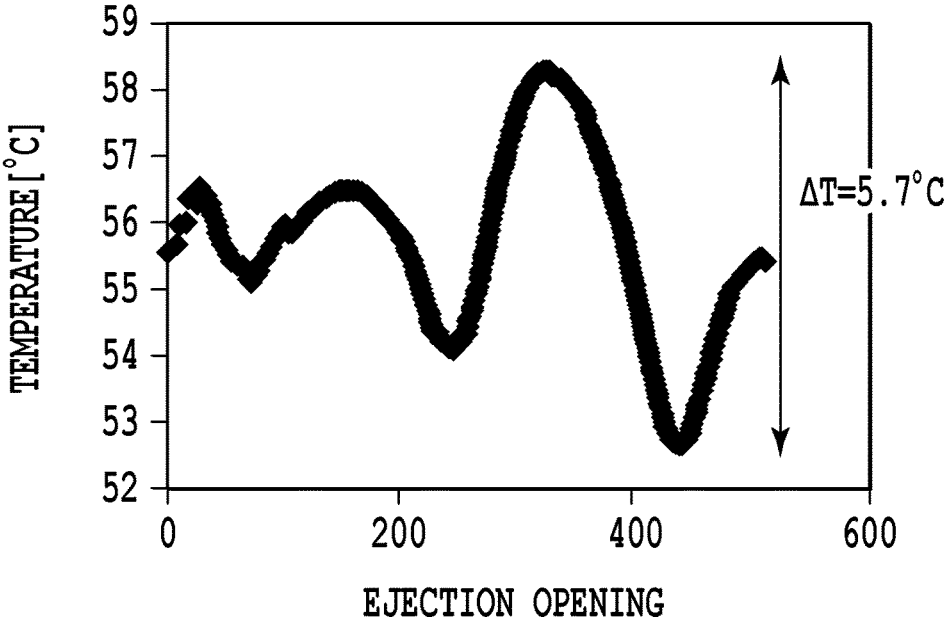
FIGS. 24A and 24B are diagrams illustrating temperature distributions along an ejection opening array as a result of the simulation.
Figure 24B:
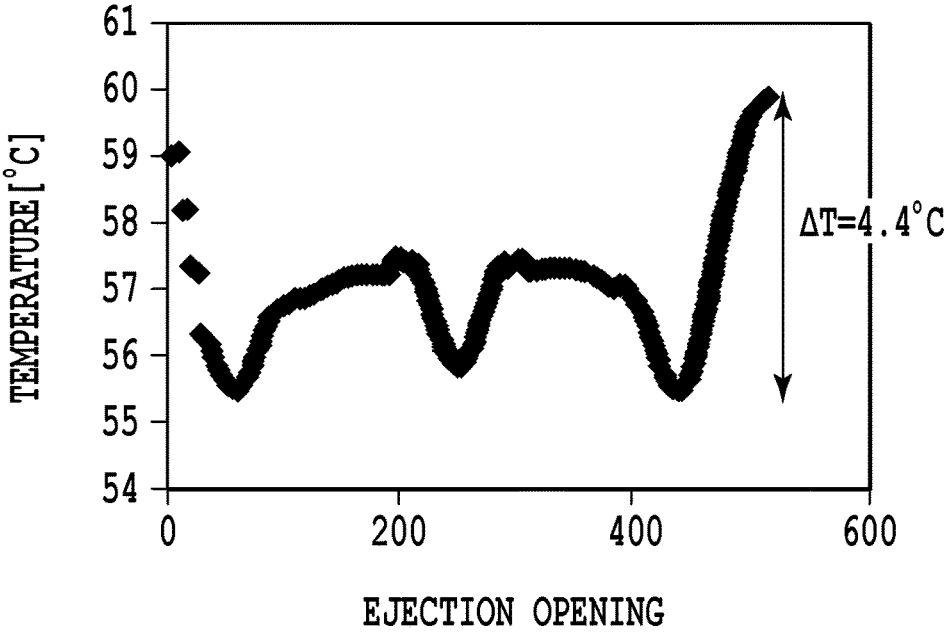

Herein, a description will be given of heat distribution improvement effect according to the present embodiment by a simulation. FIGS. 23A and 23B are diagrams illustrating a positional relation among openings 21*a*, 21*b*, the temperature adjustment heater 102, and the temperature sensor 103 for the simulation. In addition, FIGS. 24A and 24B are diagrams illustrating temperature distributions along an ejection opening array as a result of the simulation. FIG. 23A illustrates a case where the heater and the temperature sensor are arranged at a certain interval without being aligned to a position of the openings, and FIG. 24A illustrates a temperature distribution in the case. Meanwhile, FIG. 23B illustrates a case where the heater 102 and the temperature sensor 103 are arranged to correspond to a position of the openings as in the present embodiment, and FIG. 24B illustrates a temperature distribution in the case.

In an arrangement illustrated in FIG. 23A, a temperature difference $\Delta T$ in the temperature distribution is 5.7° C. as illustrated in FIG. 24A. Meanwhile, in the case where the heater 102 and the temperature sensor 103 are arranged to correspond to the position of the openings, a temperature difference ΔT in the temperature distribution is 4.4° C. as illustrated in FIG. 24B. In this way, a temperature difference in a temperature distribution which may be generated in the print element board may be effectively suppressed by arranging the heater and the sensor to correspond to the position of the openings.

(Second Embodiment)

Figure 25A:
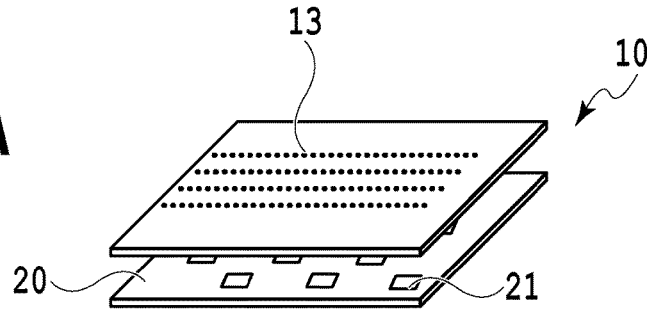
FIGS. 25A to 25C are diagrams schematically illustrating a positional relation among an opening, a heater, and a temperature sensor in a print element board of a second embodiment of the invention.
Figure 25B:
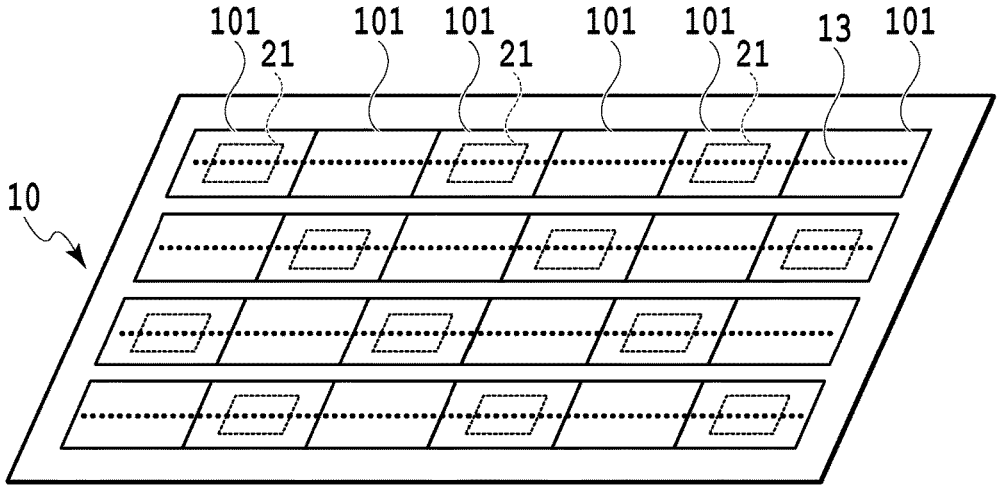
Figure 25C:
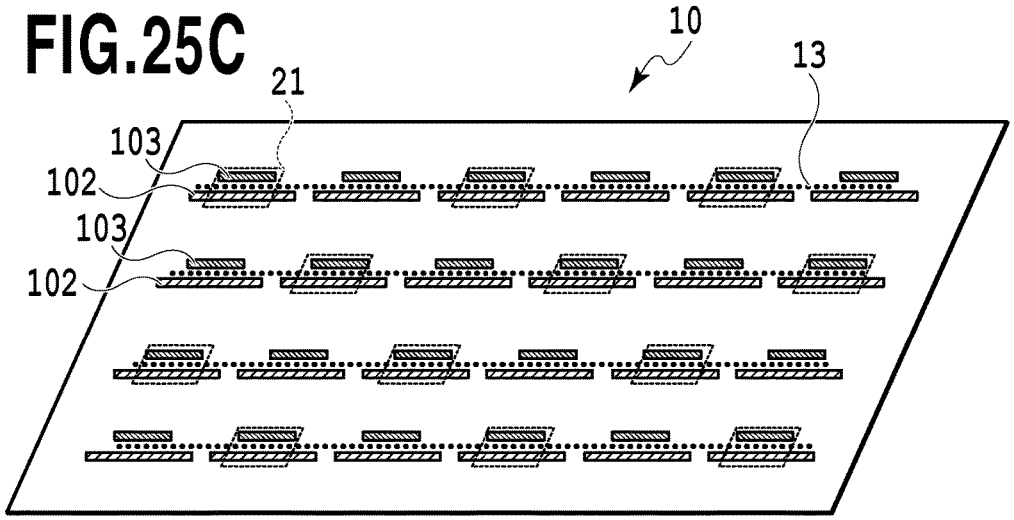

FIGS. 25A to 25C are diagrams schematically illustrating a positional relation among the opening 21, the heater, and the temperature sensor in a print element board of a second embodiment of the invention. FIG. 25A illustrates a state in which the print element board 10 and the cover plate 20 are separated from each other. The present embodiment corresponds to a mode in which only the liquid supply path is provided, that is, a mode in which ink is not circulated with respect to the ejection opening 13. The opening 21 is provided corresponding to the liquid supply path, and ink is supplied to the pressure chamber 23 and the ejection opening 13 through the opening 21. As illustrated in FIG. 25B, the temperature adjustment area 101 includes an area corresponding to each of the openings 21 and an area in which the opening 21 is not present, and these areas are arranged along the ejection opening row of the plurality of ejection openings 13. In addition, as illustrated in FIG. 25C, the temperature adjustment heater 102 and the temperature sensor 103 are arranged in each temperature control area 101. In an example illustrated in FIG. 25C, one heater 102 is present in each temperature adjustment area 101. However, a plurality of heaters may be arranged therein. In addition, a plurality of temperature sensors may be present inside one temperature control area 101.

In the above configuration, when the temperature sensor 103 detects a temperature less than or equal to a predetermined threshold temperature, heating is performed by the heater 102 present in the area. In addition, when the temperature sensor 103 detects a higher temperature than the threshold temperature, heating by the heater is suspended. As a result, in the area 101 in which the opening 21 is arranged, ink, a temperature of which is relatively low, flows in, and thus heating by the corresponding heater 102 is performed at a high frequency or for a long time by temperature control. In addition, temperature control is not performed in the area 101 in which the temperature adjustment heater 102 and the temperature sensor 103 are not arranged. As a result, in particular, heating is performed in a place in which a temperature of ink is relatively low, and a temperature variation along the ejection opening row may be relieved.

(Third Embodiment)

Figure 26:
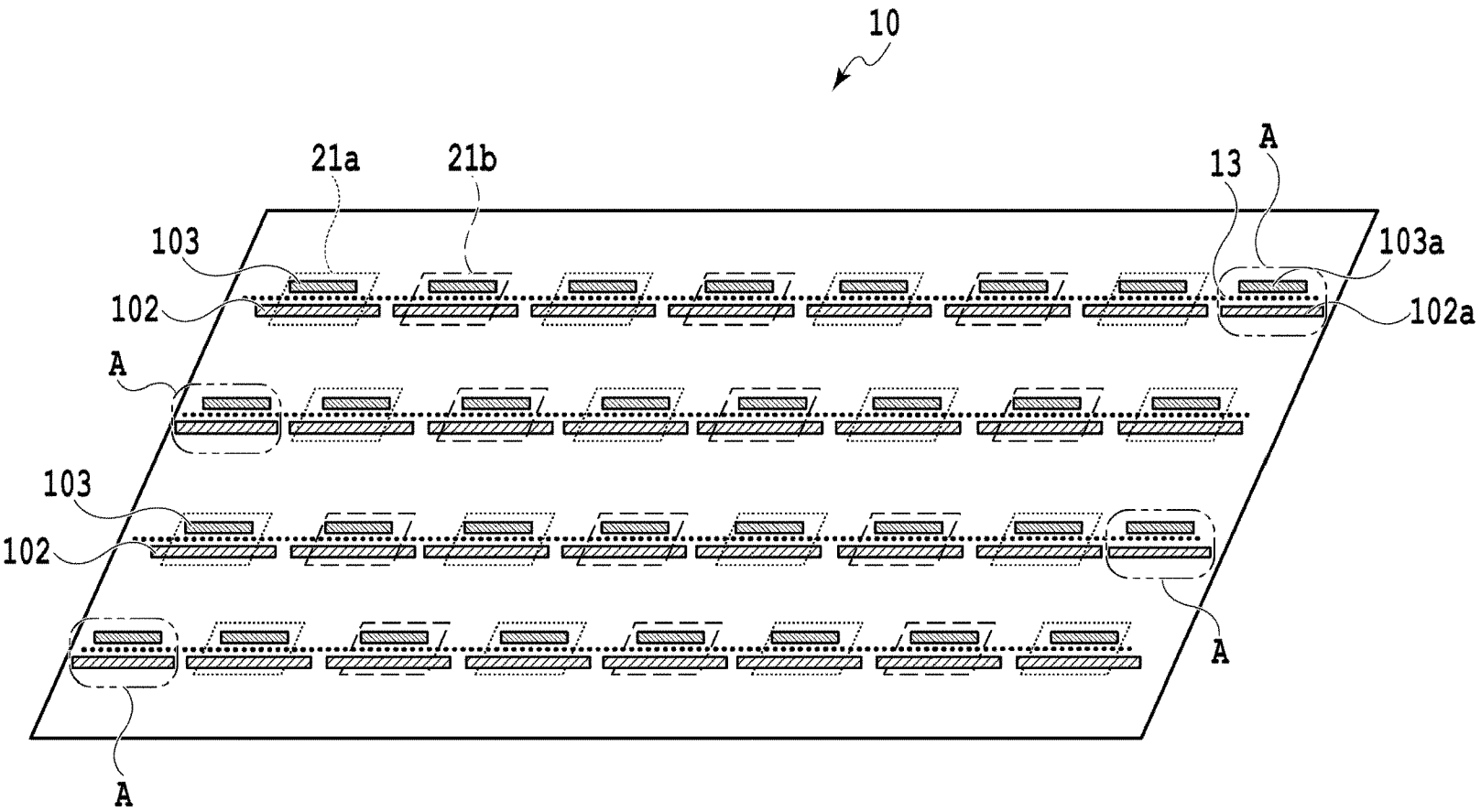
FIG. 26 is a diagram schematically illustrating a positional relation among an opening, a heater, and a temperature sensor in a print element board of a third embodiment of the invention.

FIG. 26 is a diagram schematically illustrating a positional relation among the openings 21*a*, 21*b*, the heater 102, and the temperature sensor 103 in a print element board of a third embodiment of the invention. The present embodiment has substantially the same configuration as that of the first embodiment, and is different from the first embodiment in the following point. In the first embodiment, the heater 102 and the temperature sensor 103 are arranged to correspond to the opening 21*a* for allowing ink to flow into the print element board and the opening 21*b* for allowing ink to flow out of the print element board. However, in the present embodiment, a heater 102*a* and a temperature sensor 103*a* are additionally arranged in a region (reason A), on which the openings 21*a*, 21*b* are not present, on an end portion of the ejection opening row as illustrated in FIG. 26.

Figure 27:
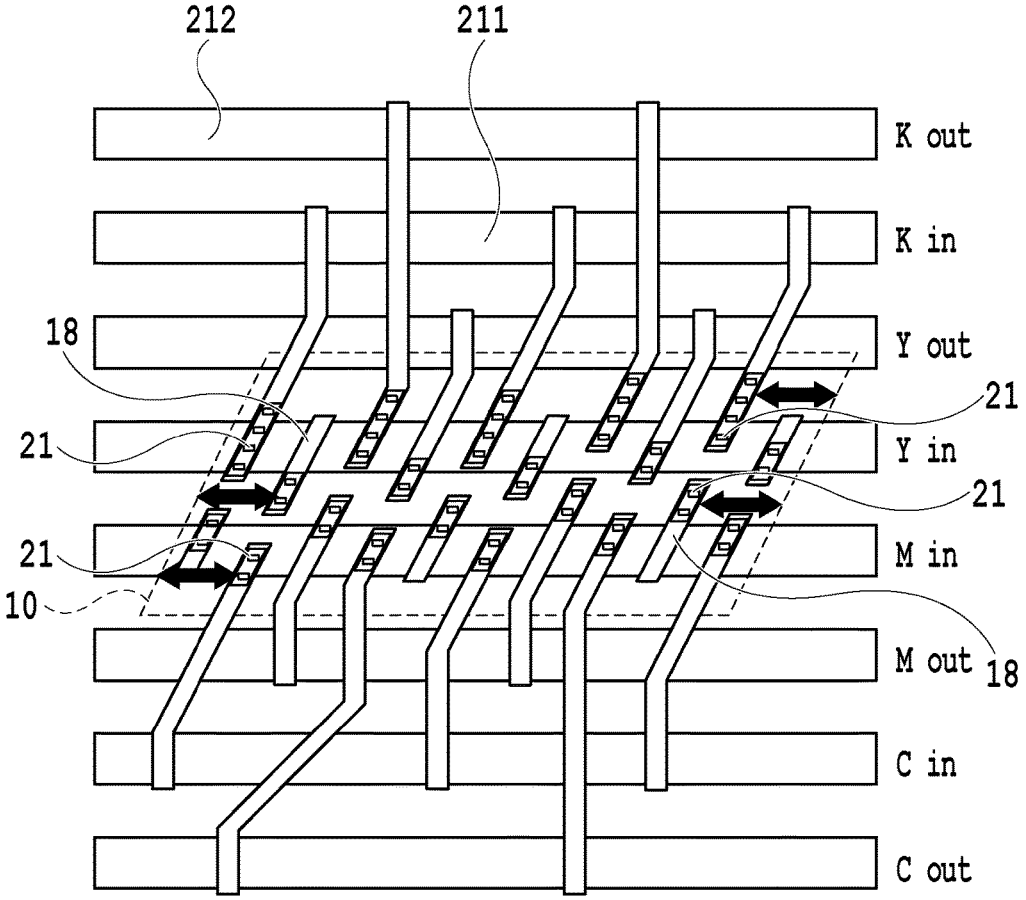
FIG. 27 is a diagram schematically illustrating a positional relation between a distribution passage and a disposition of a print element board according to an embodiment of the invention.
Figure 28:
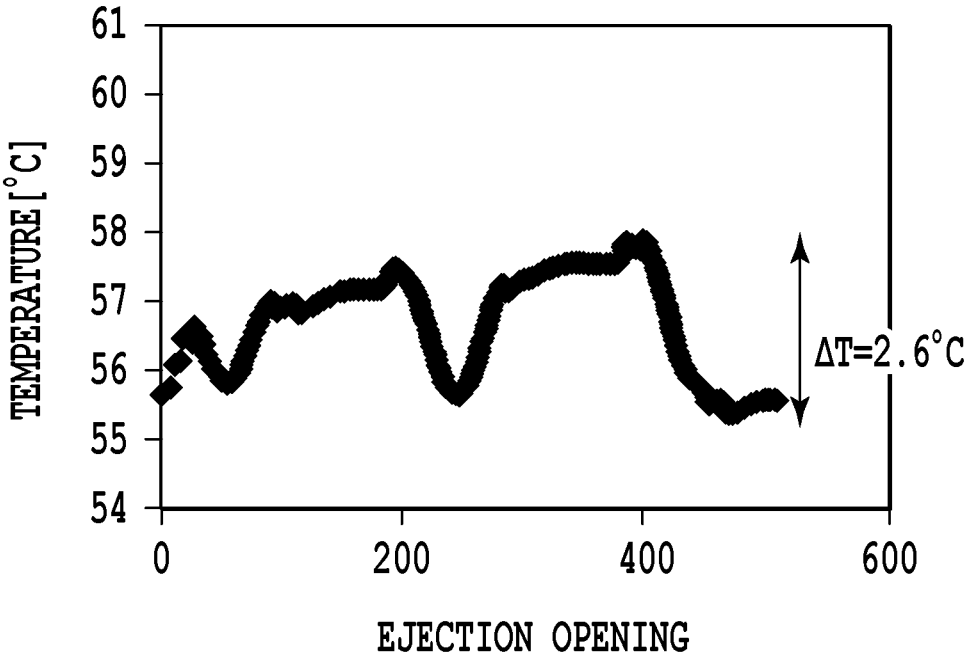
FIG. 28 is a diagram illustrating a temperature distribution along an ejection opening array as a result of a simulation according to a configuration of the print element board according to the third embodiment.

The opening 21 for allowing ink to flow in is preferably present at both ends of the print element board. However, then, as illustrated in FIG. 27, a distance of the opening 21 at one end portion side from an end of the print element board becomes long as indicated by an arrow in the figure to supply ink having a plurality of colors to one print element board. For example, in the case of black ink (K), a distance (distance along the arrow in the figure) between the opening 21 at a right side end portion and an right end of the print element board is longer than a distance between the opening 21 at a left side end portion and a left end of the print element board. As a result, ink supplied to an ejection opening at the distance from the end portion of the print element board corresponding to a right end of the graph illustrated in FIG. 24B locally increases in temperature. In FIGS. 24A and 24B, temperatures of a plurality of nozzle rows having the same color are averaged and plotted. A temperature rise is seen at a left end portion since there is a nozzle row overlapping a right end portion of an adjacent print element board, and a temperature at the portion and a temperature rise at the right end portion of the adjacent print element board are averaged, not since the temperature at the left end portion actually rises. In the present embodiment, in order to suppress the temperature rise at the end portion, as illustrated in FIG. 26, the heater 102*a* and the temperature sensor 103*a* are arranged on a region (region A), which is an end region having the longer distance between the end of the print element board and the opening 21 at the end side portion and on which the opening is not present, and temperature control is performed. In this way, as illustrated in FIG. 28, a temperature rise of ink supplied to an ejection opening at the end portion is suppressed (from 4.4° C. to 2.6° C.), and a variation of a temperature in a direction of the ejection opening row may be more relieved.

When circulation is not present, or a circulation flow amount is small, the temperature rise at the end portion is remarkable at both end portions. Thus, it is desirable to perform temperature control by additionally providing a heater and a temperature sensor to correspond both side ends rather than one end portion of the print element board.

(Fourth Embodiment)

Figure 29A:
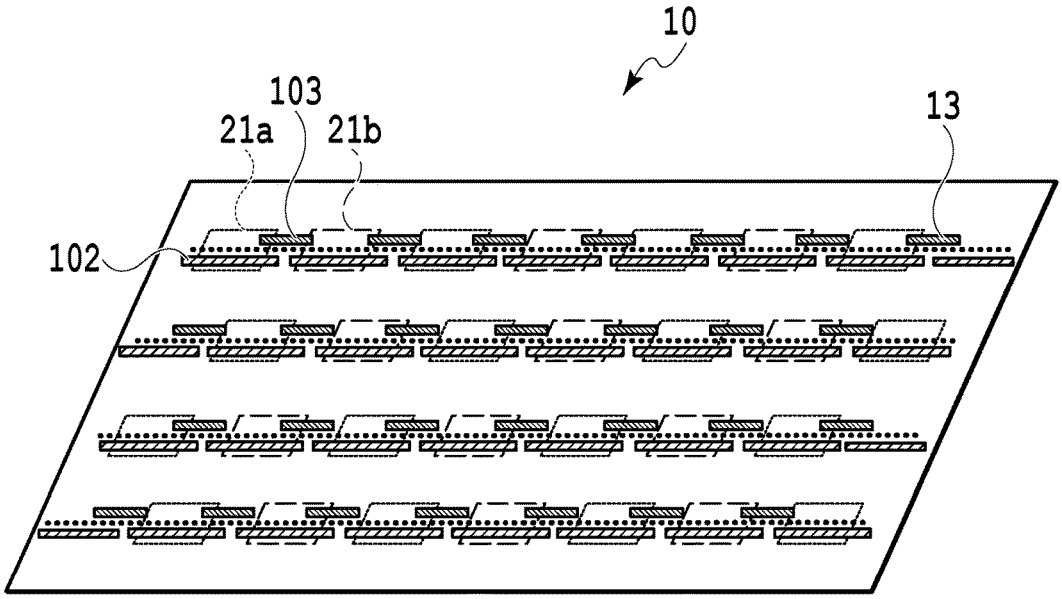
FIGS. 29A and 29B are diagrams schematically illustrating a positional relation among an opening, a heater, and a temperature sensor in a print element board of a fourth embodiment of the invention.
Figure 29B:
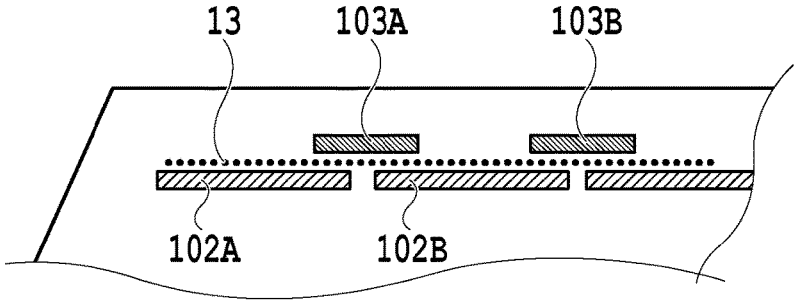

FIGS. 29A and 29B are diagrams schematically illustrating a positional relation among the opening, the heater, and the temperature sensor in a print element board of a fourth embodiment of the invention. The present embodiment basically has the same configuration as that of the first embodiment, and is different from the first embodiment in the following point.

In the present embodiment, as illustrated in FIGS. 29A and 29B, the temperature sensor 103 is arranged between adjacent heaters 102, that is, between adjacent temperature control areas. In temperature control, a reference temperature at the time of driving one heater is set to a value calculated from two temperature sensors that are positioned on both sides of the heater, and a reference temperature of an outermost circumferential heater is set to a temperature calculated from a closest temperature sensor. Herein, the calculated temperature may correspond to a simple average value, and may correspond to a weighted average value obtained by taking a distance between the heater and the temperature sensor, etc. into consideration. Specifically, in FIG. 29B, a value of a temperature sensor 103A is used when a heater 102A is driven, and a temperature calculated from values of the temperature sensor 103A and a temperature sensor 103B is used when a heater 102B is driven.

Figure 30A:
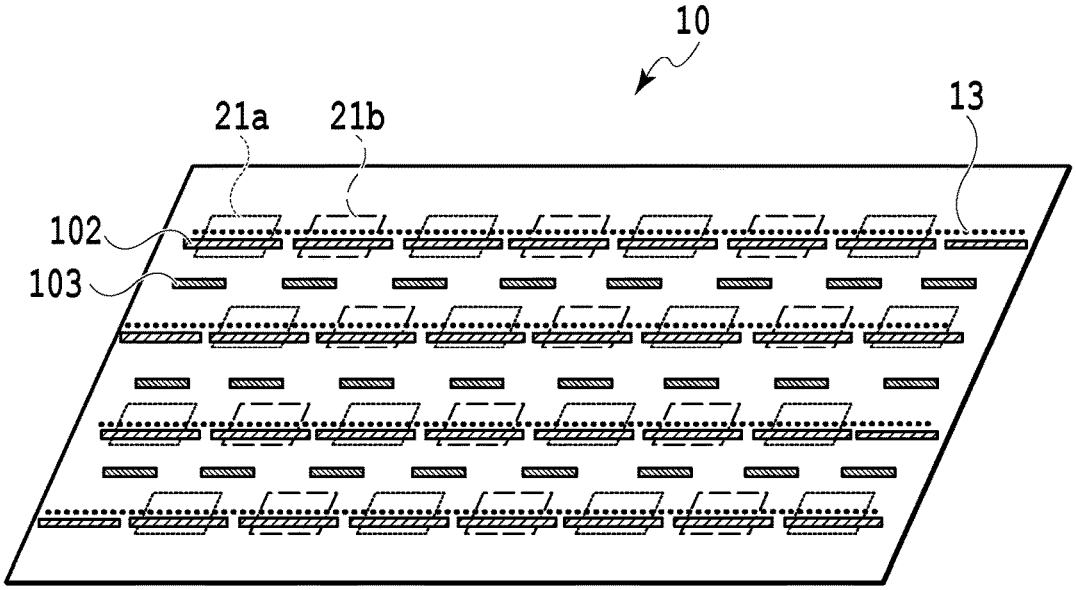
FIGS. 30A and 30B are diagrams schematically illustrating a modified example of the positional relation among the opening, the heater, and the temperature sensor in the print element board of the fourth embodiment.
Figure 30B:
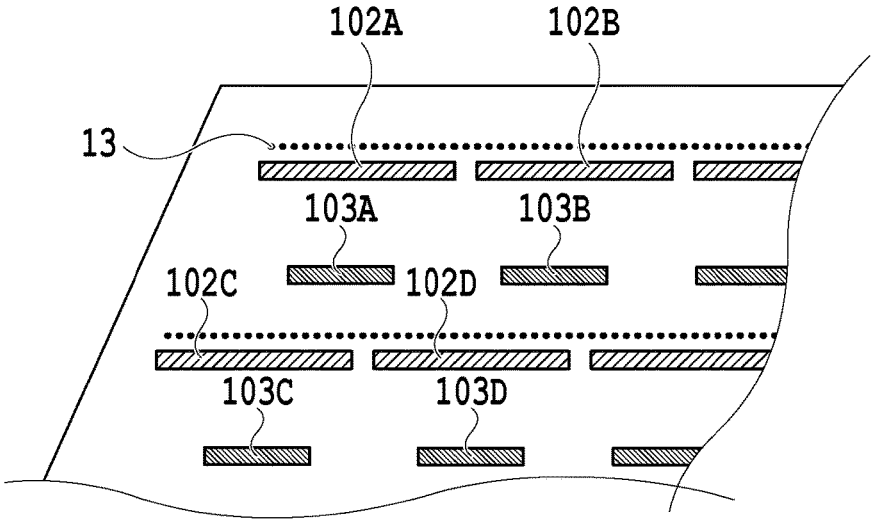

FIGS. 30A and 30B are diagrams schematically illustrating a modified example of the positional relation among the opening 21, the heater 102, and the temperature sensor 103 in the print element board of the fourth embodiment. In temperature control in this example, a value of a temperature sensor 103A is used when a heater 102A is driven in the figure. A value of a temperature sensor 103B is used when a heater 102B is driven, a value calculated from values of the temperature sensor 103A and a temperature sensor 103C is used when a heater 102C is driven, and a value calculated from values of the temperature sensor 103B and a temperature sensor 103D is used when a heater 102D is driven. In this way, appropriate temperature control may be performed using a few temperature sensors.

(Fifth Embodiment)

Figure 31:
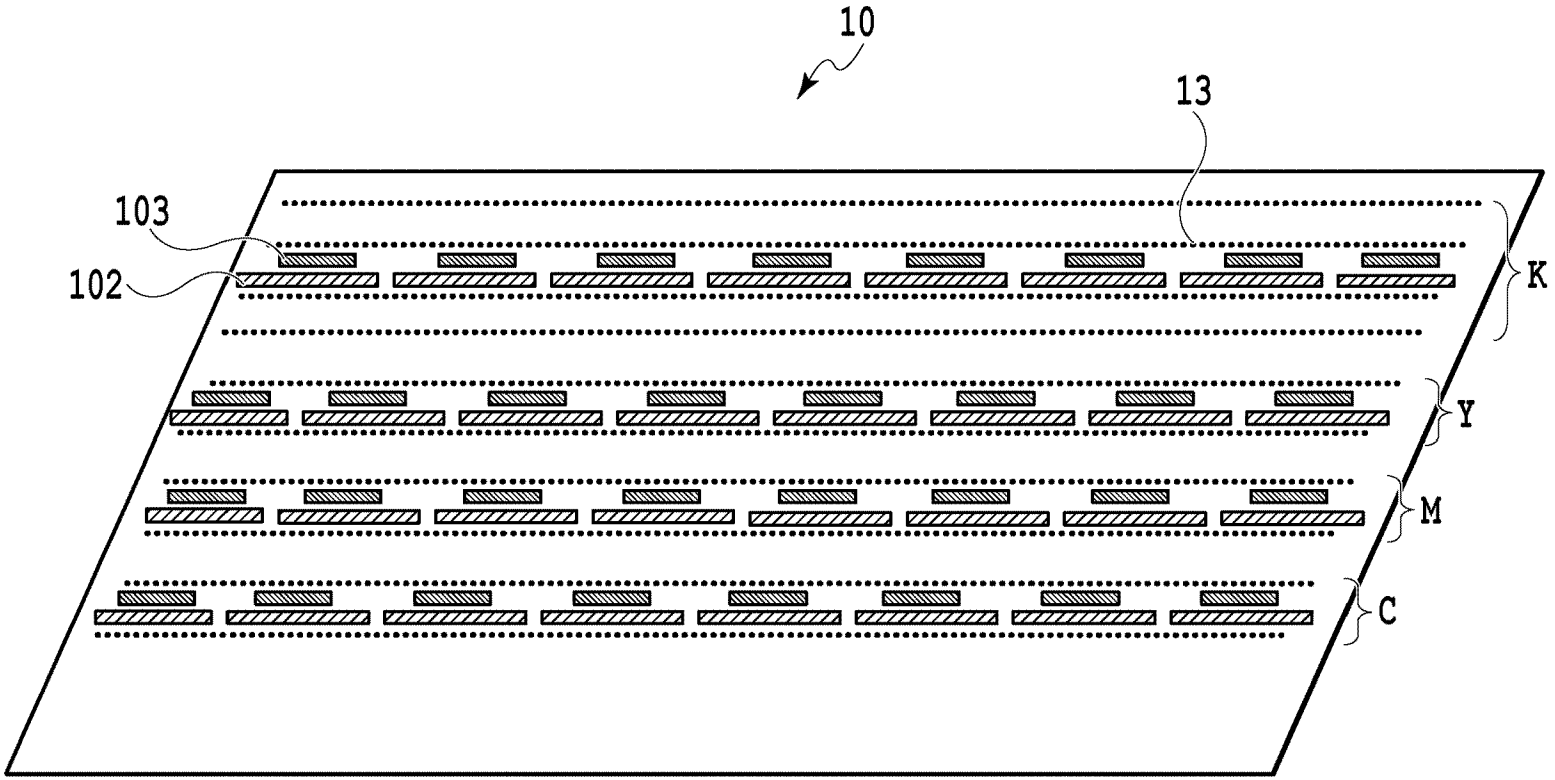
FIG. 31 is a diagram schematically illustrating a positional relation among an opening, a heater, and a temperature sensor in a print element board of a fifth embodiment of the invention.

A fifth embodiment of the invention relates to a mode in which one row of a heater and a temperature sensor is included for one ink color. In other words, when the number of ejection opening rows is different for each ink color, one row of the heater 102 and one row of the temperature sensor 103 is arranged for each ink color. For example, as illustrated in FIG. 31, in a mode in which four ejection opening rows are provided for K (black) ink, and two ejection opening rows are provided for each of Y (yellow), M (magenta), C (cyan) inks, one row of the heater 102 and the temperature sensor 103 is provided irrespective of whether the number of ejection opening rows is large or small. In this mode, it is desirable to arrange the heater 102 and the temperature sensor 103 around a center of a plurality of ejection opening rows since, when a plurality of ejection opening rows for ink of the same color are present, the ejection opening rows are generally evenly used, and thus temperature control may not be separately performed for the ejection opening rows for ink of the same color. In this way, the number of heaters and temperature sensors may be reduced, and the print element board may be further miniaturized. In FIG. 31, even though any of the openings described in the above embodiments may be provided, illustration thereof is omitted.

(Another Embodiment)

Figure 32A:
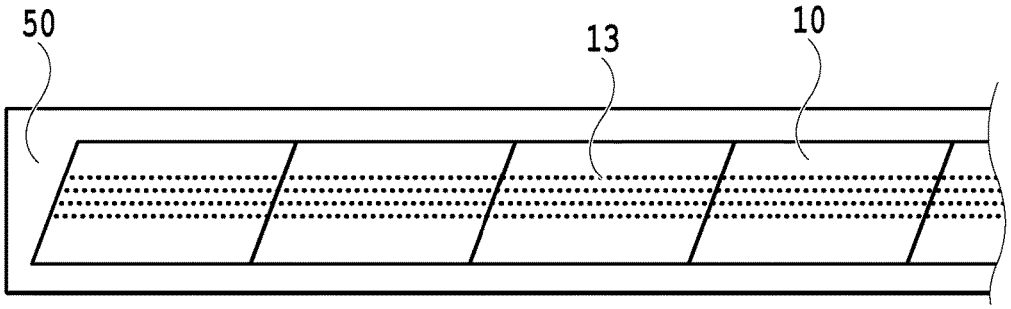
FIGS. 32A and 32B are diagrams illustrating shape examples and disposition examples of print element boards according to embodiments of the invention.
Figure 32B:
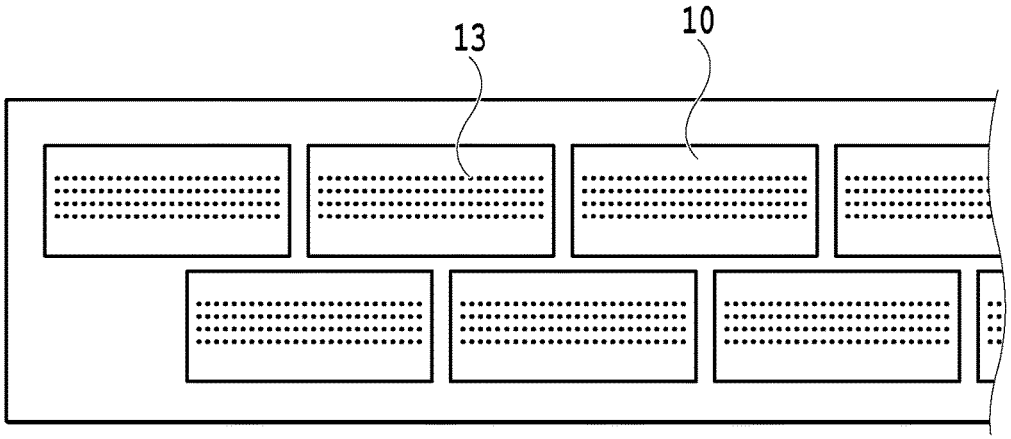

FIGS. 32A and 32B are diagrams illustrating shape examples and disposition examples of print element boards according to embodiments of the invention. FIG. 32A illustrates a shape and a disposition of the print element board according to the first to fifth embodiments described above with reference to FIG. 13, etc., and corresponds to a so-called in-line configuration in which print element boards are arranged in a row (in a linear arrangement). Meanwhile, FIG. 32B illustrates a zigzag configuration in which print element boards are alternately arranged, and such a zigzag configuration may be used. The in-line configuration is advantageous over the zigzag configuration in terms of cost since the liquid ejection head may be set to be small, and a total area of the print element boards may be set to be small. Meanwhile, in the zigzag configuration, a connecting portion of print element boards may have a lot of surplus ejection openings, and reliability of image quality may be ensured. In addition, even though an example in which the invention is applied to a print element board that ejects multi-color ink has been described in the above embodiments, the invention may be similarly applied to a monocolor print element board.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-025233, filed Feb. 12, 2016, and No. 2017-000595, filed Jan. 5, 2017, which are hereby incorporated by reference herein in their entirety.

What is claimed is:

1. A liquid ejection head provided with an ejection opening row in which a plurality of ejection openings for ejecting a liquid are arranged, the liquid ejection head comprising:

pressure chambers that communicate with the ejection openings and include a pressure generation element inside each of the pressure chambers, each pressure generation element generating pressure used for ejecting the liquid;

a supply path extending along the ejection opening row and supplying the liquid to the pressure chambers;

a supply opening for supplying liquid to the supply path;

a collection path extending along the ejection opening row and collecting liquid from the pressure chambers;

a collection opening for collecting liquid from the collection path;

a plurality of heaters provided along the ejection opening row; and a plurality of temperature sensors provided along the ejection opening row, wherein at least one heater and at least one temperature sensor are provided in the vicinity of each of the supply opening and the collection opening.

2. The liquid ejection head according to claim 1, wherein the heaters and the temperature sensors are provided between the supply opening and the collection opening.

3. The liquid ejection head according to claim 1, wherein a plurality of the supply openings are provided, and the heaters and the temperature sensors are provided around each of the plurality of the supply openings and between the plurality of the supply openings.

4. The liquid ejection head according to claim 1, wherein a plurality of the collection openings are provided, and the heaters and the temperature sensors are provided around each of the plurality of the collection openings and between the plurality of the collection openings.

5. The liquid ejection head according to claim 1, wherein the heaters and the temperature sensors are provided in respective regions adjacent to both end portions of the ejection opening row.

6. The liquid ejection head according to claim 1, wherein the heaters and the temperature sensors are provided in a region adjacent to one of end portions of the ejection opening row.

7. The liquid ejection head according to claim 1, wherein liquid inside the pressure chambers is circulated between the pressure chambers and an outside of the pressure chambers.

8. The liquid ejection head according to claim 1, further comprising:

an ejection opening formation member in which the ejection opening row is provided; and a substrate joined to the ejection opening formation member, wherein the pressure generation elements, the heaters, and the temperature sensors are provided on a side of one surface of the substrate, and the ejection opening row is provided on a side of a rear surface with respect to the one surface.

9. The liquid ejection head according to claim 8, wherein a cover plate in which the ejection opening row is formed is arranged on the side of the rear surface of the substrate.

10. The liquid ejection head according to claim 1, wherein liquids inside the pressure chambers are circulated between the pressure chambers and outside of the pressure chambers.

11. A liquid ejection apparatus that ejects a liquid using a liquid ejection head provided with an ejection opening row in which a plurality of ejection openings for ejecting the liquid are arranged, wherein the liquid ejection head includes pressure chambers that communicate with the ejection openings and includes a pressure generation element inside each of the pressure chambers, a supply path extending along the ejection opening row and supplying the liquid to the pressure chambers, a supply opening for supplying liquid to the supply path, a collection path extending along the ejection opening row and collecting liquid from the pressure chambers, a collection opening for collecting liquid from the collection path, a plurality of heaters provided along the ejection opening row, and a plurality of temperature sensors provided along the ejection opening row, the liquid ejection apparatus includes a control unit configured to control a temperature of the liquid ejection head, the control unit controls driving of the heaters based on a temperature detected by the temperature sensors, and at least one heater and at least one temperature sensor are provided in the vicinity of each of the supply opening and the collection opening.

12. The liquid ejection apparatus according to claim 11, wherein the control unit drives the heaters to heat the liquid when the temperature detected by the temperature sensors is less than or equal to a predetermined threshold temperature.

13. The liquid ejection apparatus according to claim 12, wherein the liquid ejection head has a plurality of temperature sensors around each of the heaters, and the control unit drives the heaters to heat the liquid when a temperature calculated from the plurality of temperature sensors around the heater is less than or equal to the threshold temperature.

14. The liquid ejection apparatus according to claim 11, wherein the liquid ejection head includes an ejection opening row for each of a plurality of ink colors, and the control unit controls driving of the heaters based on the temperature detected by the temperature sensors for each of the plurality of ink colors.

15. The liquid ejection apparatus according to claim 11, further comprising a circulation unit configured to circulate the liquid in the pressure chambers between the pressure chambers and outside of the pressure chambers.

* * * * *